US012672705B1

(12) United States Patent
Sibbesen et al.

(10) Patent No.: US 12,672,705 B1
(45) Date of Patent: Jul. 7, 2026

(54) PORTABLE ELECTRONIC DEVICE CASE STAND MODULAR SYSTEM

(71) Applicant: Pioneer Square Brands, Inc., High Point, NC (US)

(72) Inventors: Soren Sibbesen, Jamestown, NC (US); Brian Lewis Piper, Seattle, WA (US); Quentin Wade Forbes, Winston Salem, NC (US); Richard Kennedy, Antioch, TN (US)

(73) Assignee: Pioneer Square Brands, Inc., High Point, NC (US)

( * ) Notice: Subject to any disclaimer, the term of this patent is extended or adjusted under 35 U.S.C. 154(b) by 0 days.

(21) Appl. No.: 19/433,823

(22) Filed: Dec. 28, 2025

Related U.S. Application Data

(60) Provisional application No. 63/789,384, filed on Apr. 15, 2025.

(51) Int. Cl.
*A45C 11/00* (2006.01)
*A45C 13/04* (2006.01)

(52) U.S. Cl.
CPC ..... *A45C 11/002* (2025.01); *A45C 11/003* (2025.01); *A45C 13/04* (2013.01); *A45C 2200/15* (2013.01)

(58) Field of Classification Search
CPC ..... A45C 11/00; A45C 11/002; A45C 11/003; A45C 2200/15; H04M 1/04; H04B 1/3888; H04B 1/3877
See application file for complete search history.

(56) References Cited

U.S. PATENT DOCUMENTS 10,855,821 B1 * 12/2020 Chou ..... H04B 1/3877
11,251,824 B2 * 2/2022 Flores ..... H04M 1/185

* cited by examiner

*Primary Examiner* — Corey N Skurdal
(74) *Attorney, Agent, or Firm* — Grandview Law

(57) ABSTRACT

A case system for a portable electronic device includes a back member couplable with the portable electronic device and defining a recessed region and a stand-coupling structure. A two-piece folding stand is coupled to the back member and includes a first stand member and a second stand member hingedly coupled to the first stand member. The stand is movable between a stowed condition in which the stand members fold to lie along the back member and are received in the recessed region, and a deployed condition in which the stand members are angled with respect to one another to define a braced support for supporting the device on a support surface. In some versions, a frame member is couplable with the back member to retain the portable electronic device therebetween.

20 Claims, 42 Drawing Sheets

PORTABLE ELECTRONIC DEVICE CASE STAND MODULAR SYSTEM

In one or more aspects a case system for a portable electronic device, including (I) a back member including: (A) a rear surface portion, (B) an interior surface portion opposite the rear surface portion, (C) a first recessed region, and (D) a first stand-coupling structure; (II) a frame member including: (A) a perimeter body portion defining a central opening, and (B) an inwardly extending ledge portion; and (III) a two-piece folding stand including: (A) a first stand member, and (B) a second stand member hingedly coupled to the first stand member, wherein the first stand member is coupled to the back member by the first stand-coupling structure; wherein the first stand member and the second stand member are movable between (i) a stowed condition in which the first stand member and the second stand member are folded to lie along the back member and (ii) a deployed condition in which the first stand member and the second stand member are angled with respect to one another to support the case system on a support surface, and wherein, in the stowed condition, at least a portion of the two-piece folding stand is received within the first recessed region.

In implementations the first stand-coupling structure includes at least one elongated aperture and at least one notch portion.

In implementations the first stand member includes a peg portion received in the at least one elongated aperture.

In implementations the hinge coupling includes a peg portion on one of the first stand member and the second stand member, and a side aperture on the other of the first stand member and the second stand member, the peg portion being received in the side aperture.

In implementations the second stand member includes a plurality of extended portions defining at least one ground-contact region in the deployed condition.

In implementations the back member includes at least one rib portion, and wherein the frame member includes a circumferential groove portion receiving the at least one rib portion.

Implementations include a transparent sheet disposed along the inwardly extending ledge portion and spanning across the central opening.

In one or more aspects a A back assembly for a portable electronic device, comprising: (I) a back member couplable with the portable electronic device and including: (A) a rear surface portion, (B) an interior surface portion opposite the rear surface portion, (C) a recessed region, and (D) a stand-coupling structure; and (II) a two-piece folding stand coupled with the back member by the stand-coupling structure, the two-piece folding stand including: (A) a first stand member coupled with the stand-coupling structure, and (B) a second stand member hingedly coupled to the first stand member, wherein the two-piece folding stand is movable between (i) a stowed condition in which at least a portion of the two-piece folding stand is received in the recessed region and (ii) a deployed condition in which the first stand member and the second stand member are angled with respect to one another to support the back assembly on a support surface while the back member remains coupled with the portable electronic device.

Implementations include a frame member couplable with the portable electronic device and couplable with the back member.

In implementations the frame member includes a perimeter body defining a central opening.

In implementations the frame member includes an inwardly extending ledge portion adjacent the central opening.

In implementations the hinge coupling includes a peg portion on the first stand member and a side aperture on the second stand member, the peg portion being received in the side aperture.

In implementations the second stand member includes a second side aperture receiving a second peg portion of the first stand member.

In implementations the recessed region includes a sunken portion of the back member.

In one or more aspects a A modular enclosure system for a portable electronic device, comprising: (I) a back assembly including: (A) a back member including a recessed region and a stand-coupling structure, and (B) a two-piece folding stand including a first stand member and a second stand member hingedly coupled to the first stand member, the first stand member being coupled to the stand-coupling structure; and (II) a frame member removably couplable with the back assembly and including: (A) a perimeter body defining a central opening, and (B) a ledge portion adjacent the central opening; wherein, when the frame member is coupled with the back assembly, the portable electronic device is retainable between the frame member and the back member, and wherein the two-piece folding stand is movable between a stowed condition in which the two-piece folding stand is received in the recessed region and a deployed condition in which the first stand member and the second stand member are angled with respect to one another to support the modular enclosure system on a support surface.

In implementations the back member includes a rib portion and the frame member includes a groove portion receiving the rib portion.

In implementations the groove portion extends along at least two sides of the perimeter body.

In implementations the stand-coupling structure includes an elongated aperture and a ramp portion adjacent the elongated aperture.

In implementations the stand-coupling structure further includes a notch portion adjacent the elongated aperture, and wherein the first stand member includes a coupling feature seated in the notch portion in the stowed condition.

Implementations include a transparent sheet supported by the ledge portion and spanning across the central opening.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of Portable Electronic Device Case Stand Modular System, articles of manufacture, compositions of matter for same that may provide context, for instance, in introducing one or more processes and/or devices described herein.

Figure Descriptions for Present Application

Figure 1:
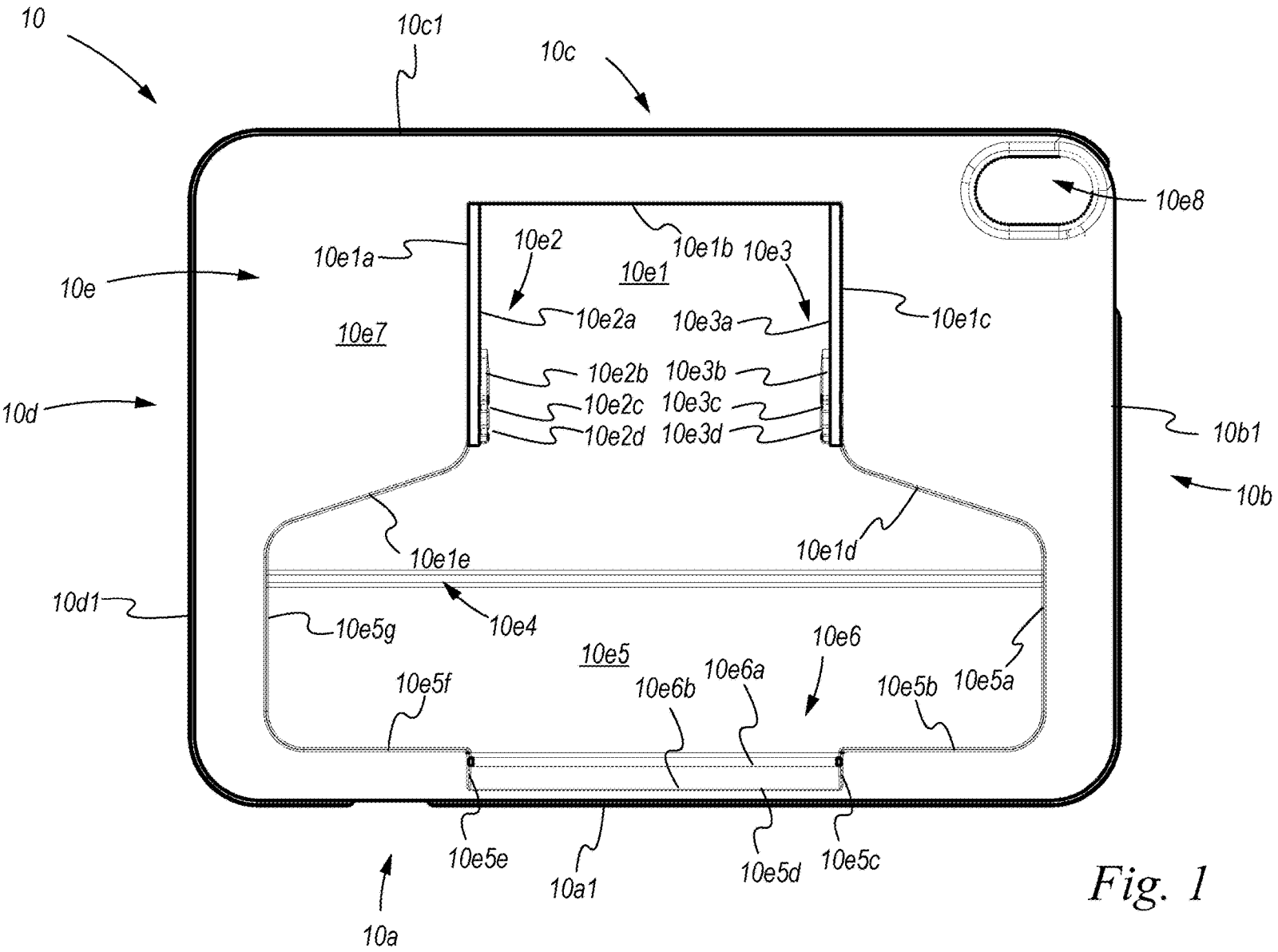

FIG. 1 is a rear plan view of a back member of a back assembly.

Figure 2:
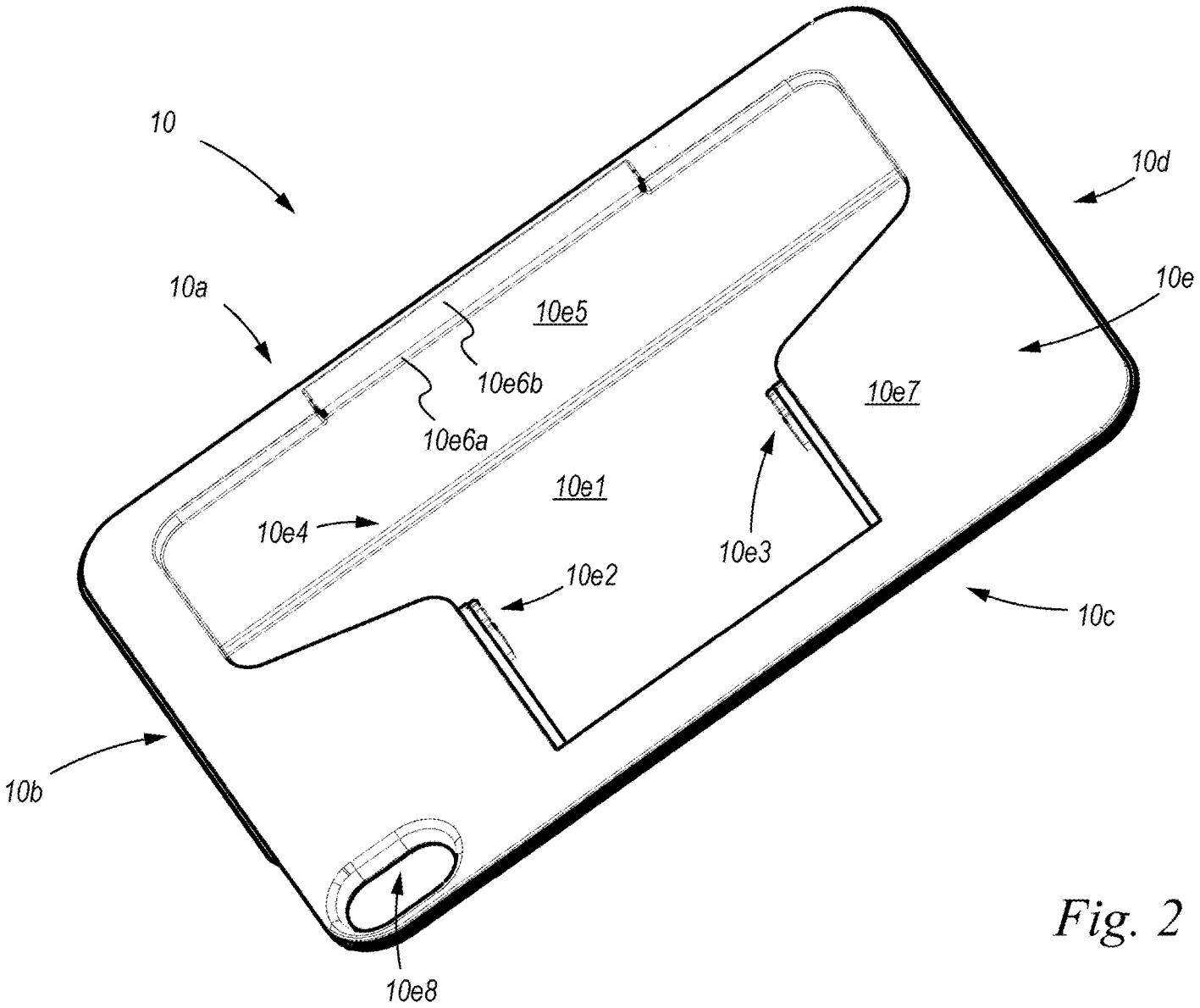

FIG. 2 is a first rear perspective view of the back member of FIG. 1.

Figure 3:
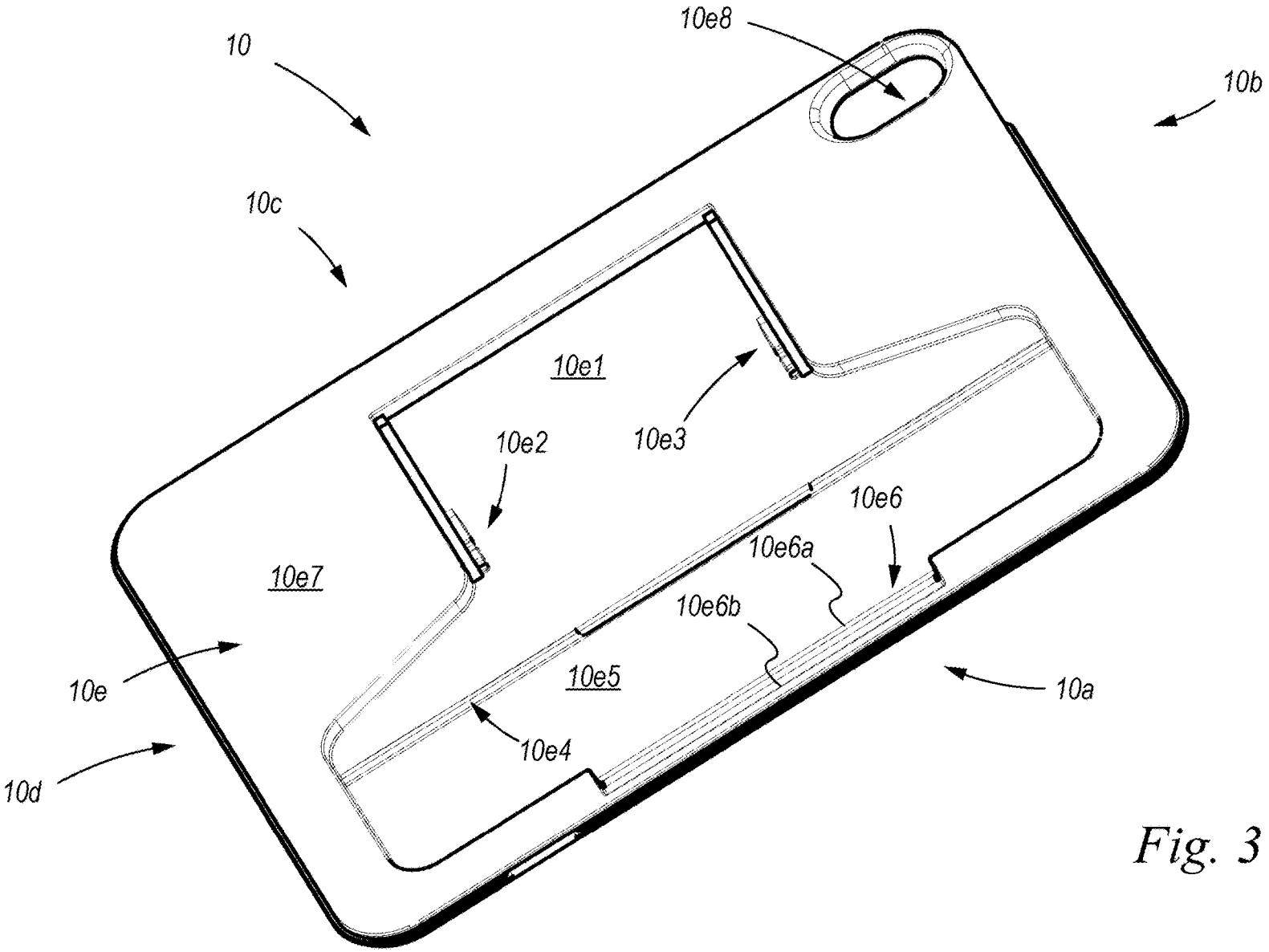

FIG. 3 is a second rear perspective view of the back member of FIG. 1.

Figure 4:
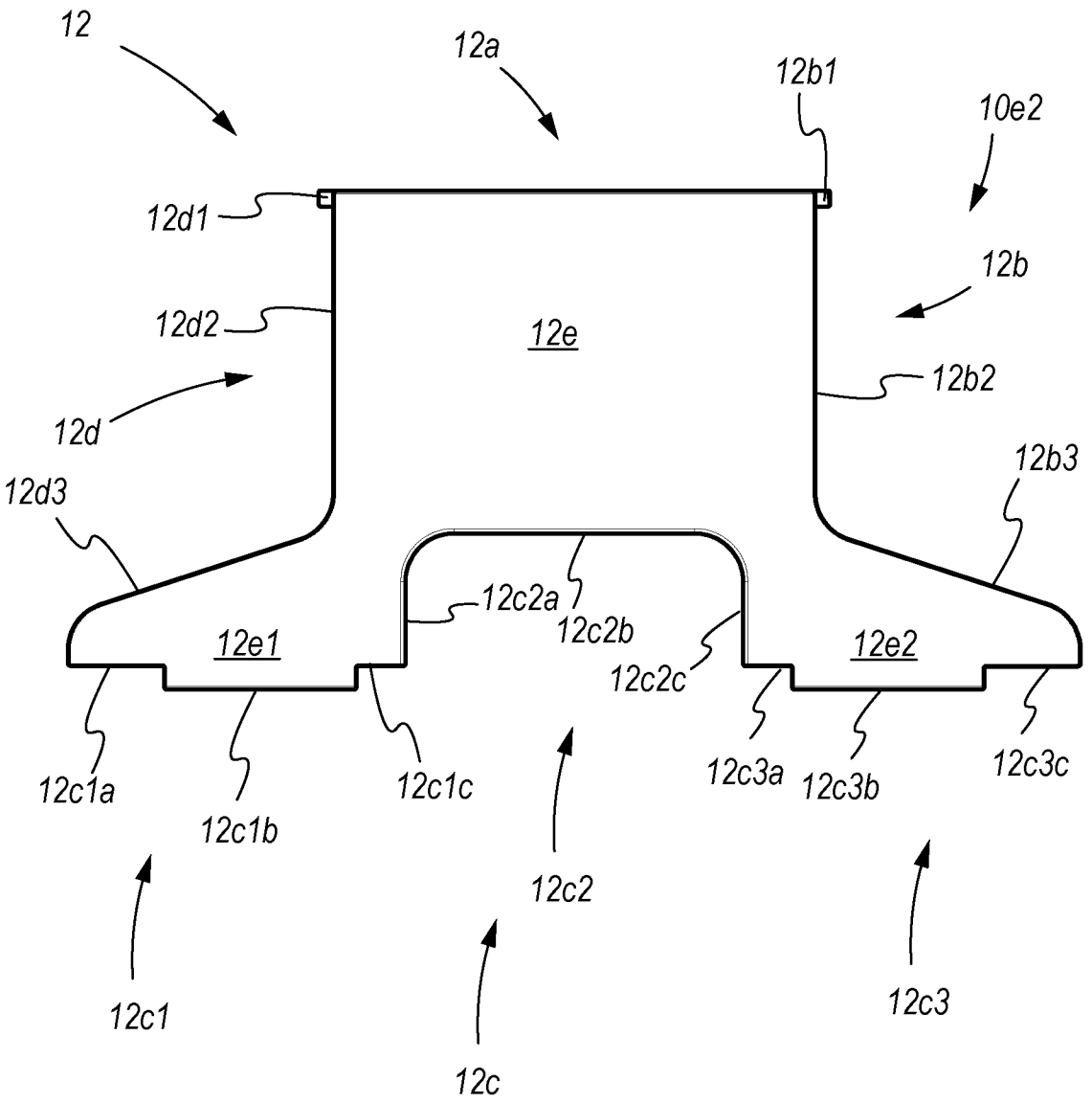

FIG. 4 is a rear plan view of a first stand member of the back assembly.

Figure 5:
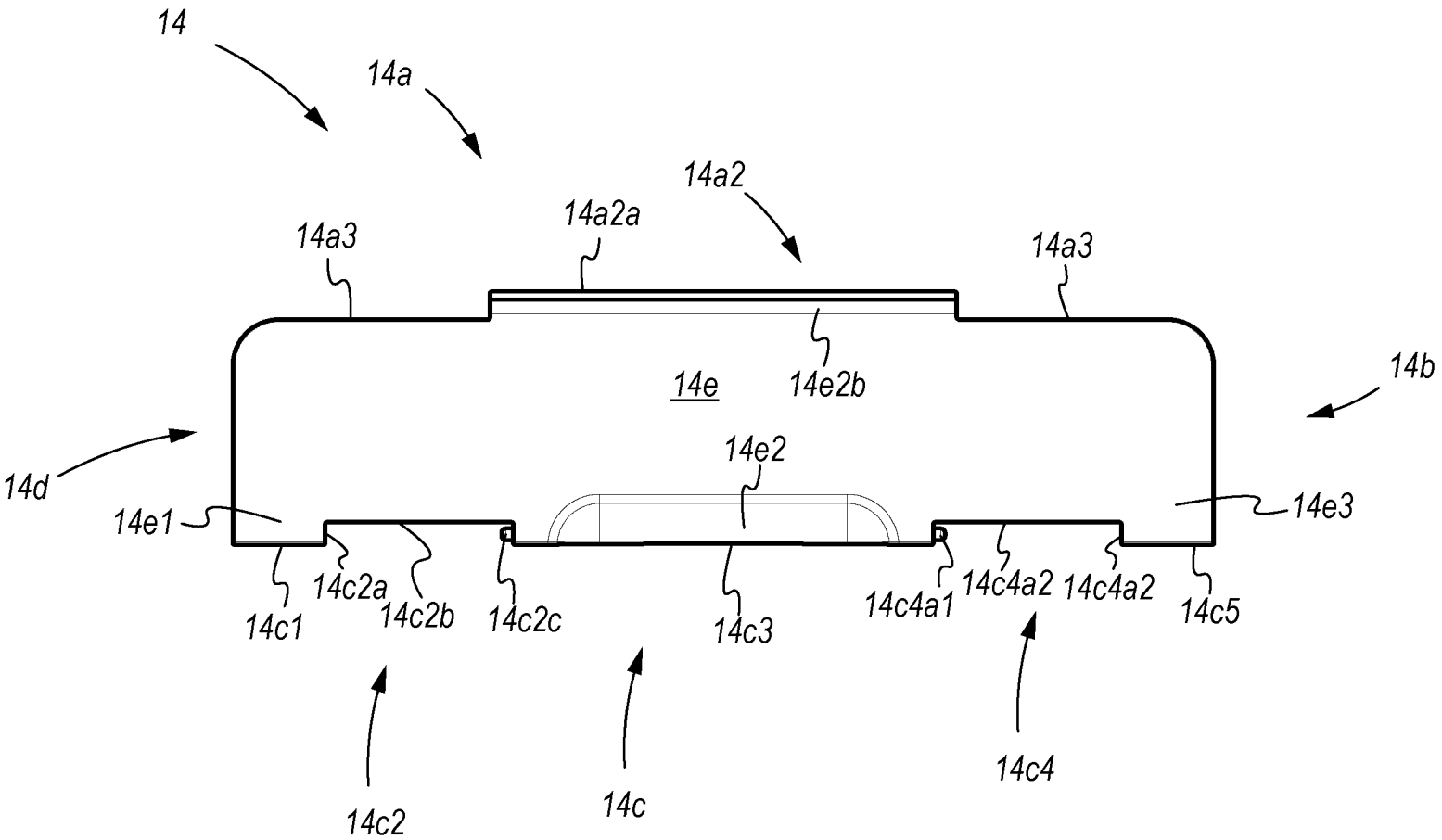

FIG. 5 is a rear plan view of a second stand member of the back assembly.

Figure 6:
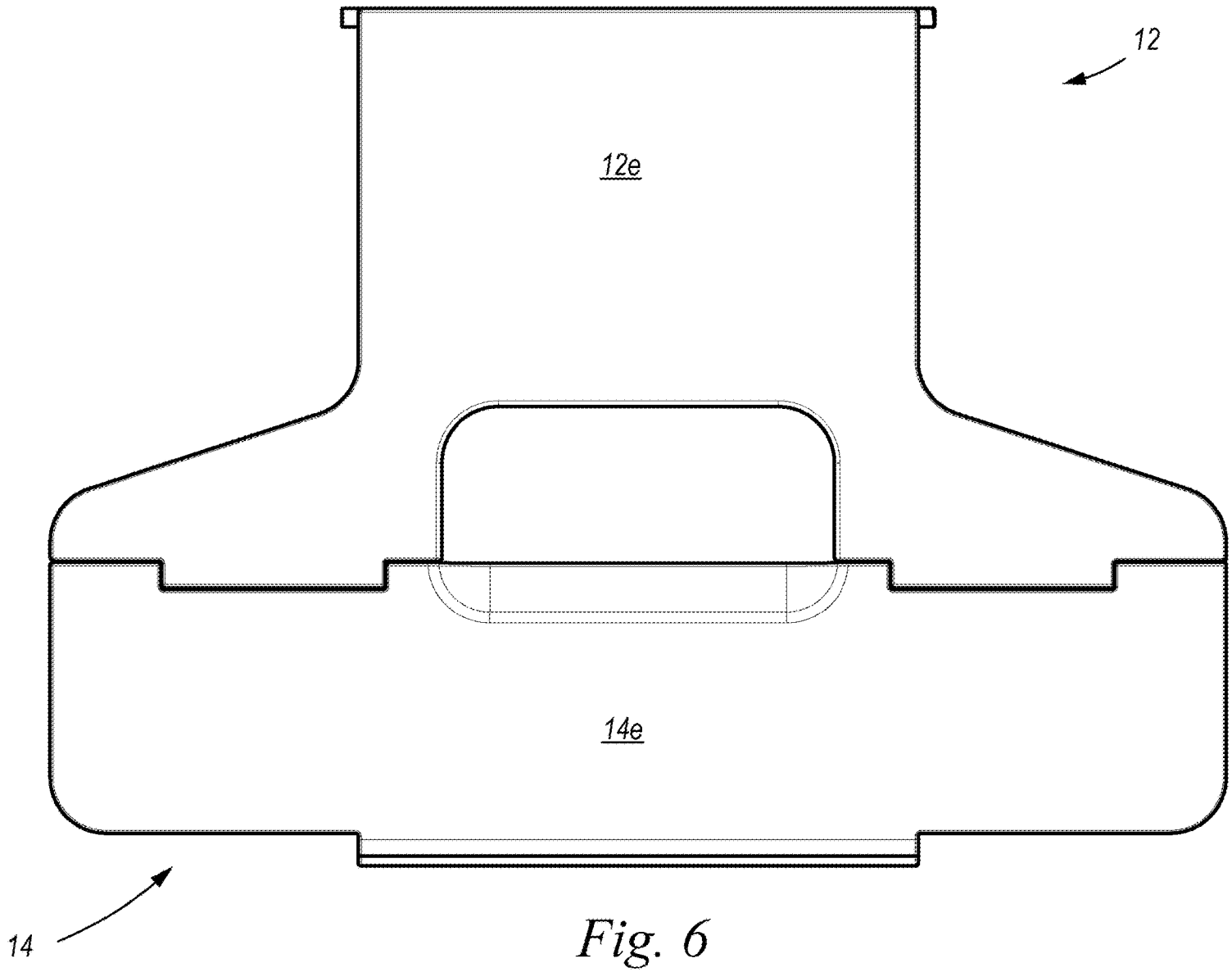

FIG. 6 is a rear plan view of the first stand member of FIG. 4 coupled with the second stand member of FIG. 5.

Figure 7:
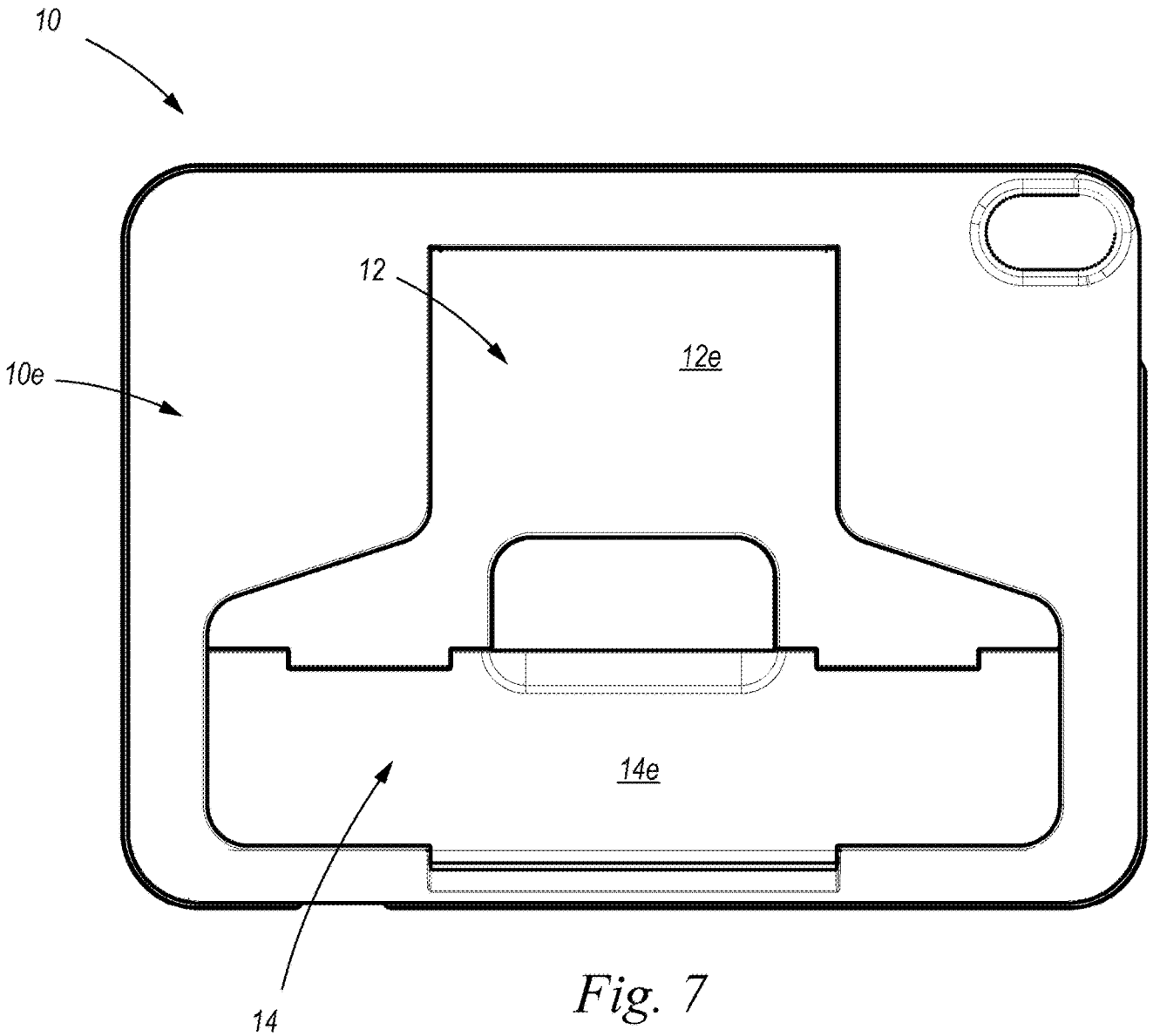

FIG. 7 is a rear plan view of the first stand member of FIG. 4 coupled with the second stand member of FIG. 5, and both coupled with the back member of FIG. 1 all of the back assembly.

Figure 8:
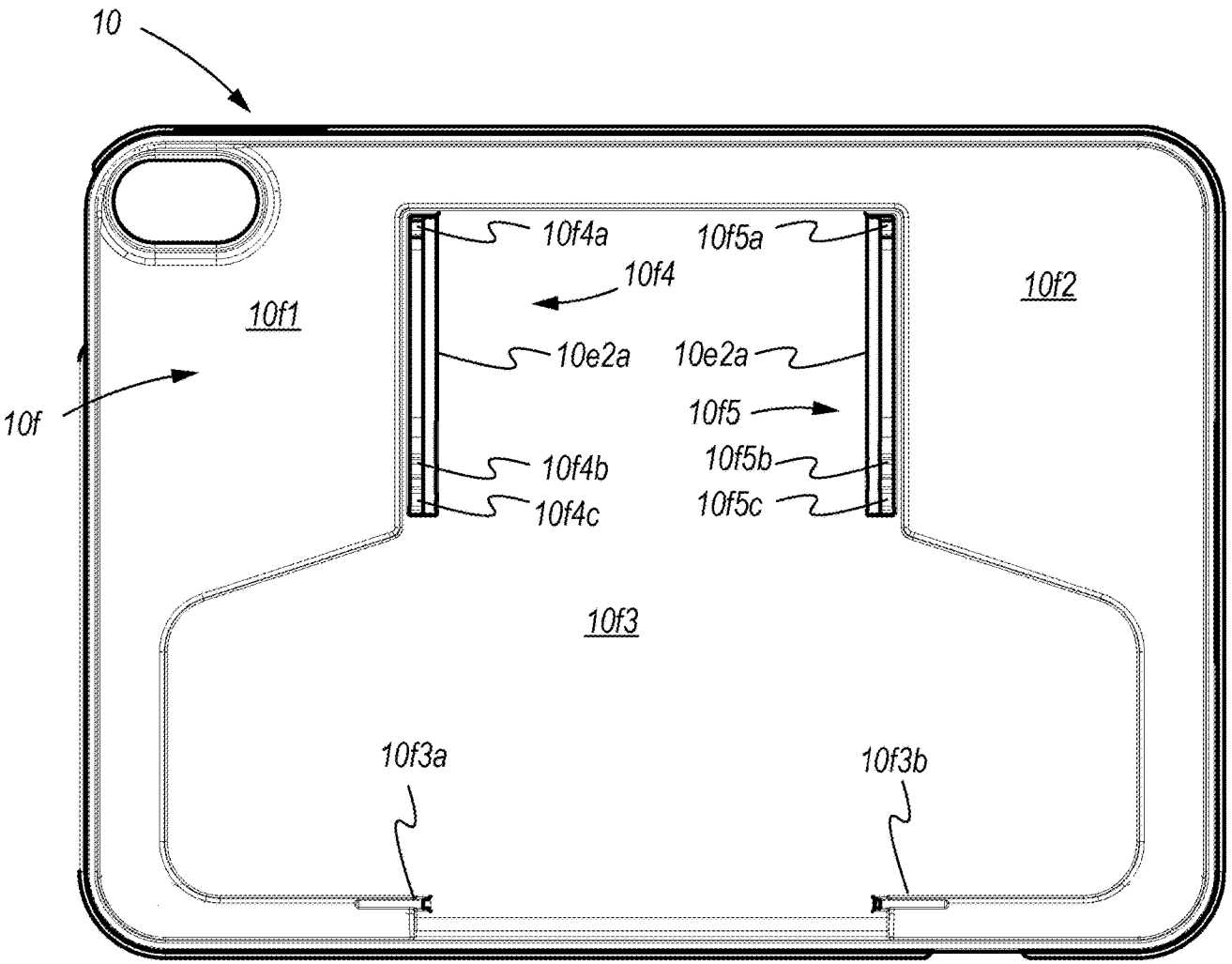

FIG. 8 is a front plan view of the back member of FIG. 1.

Figure 9:
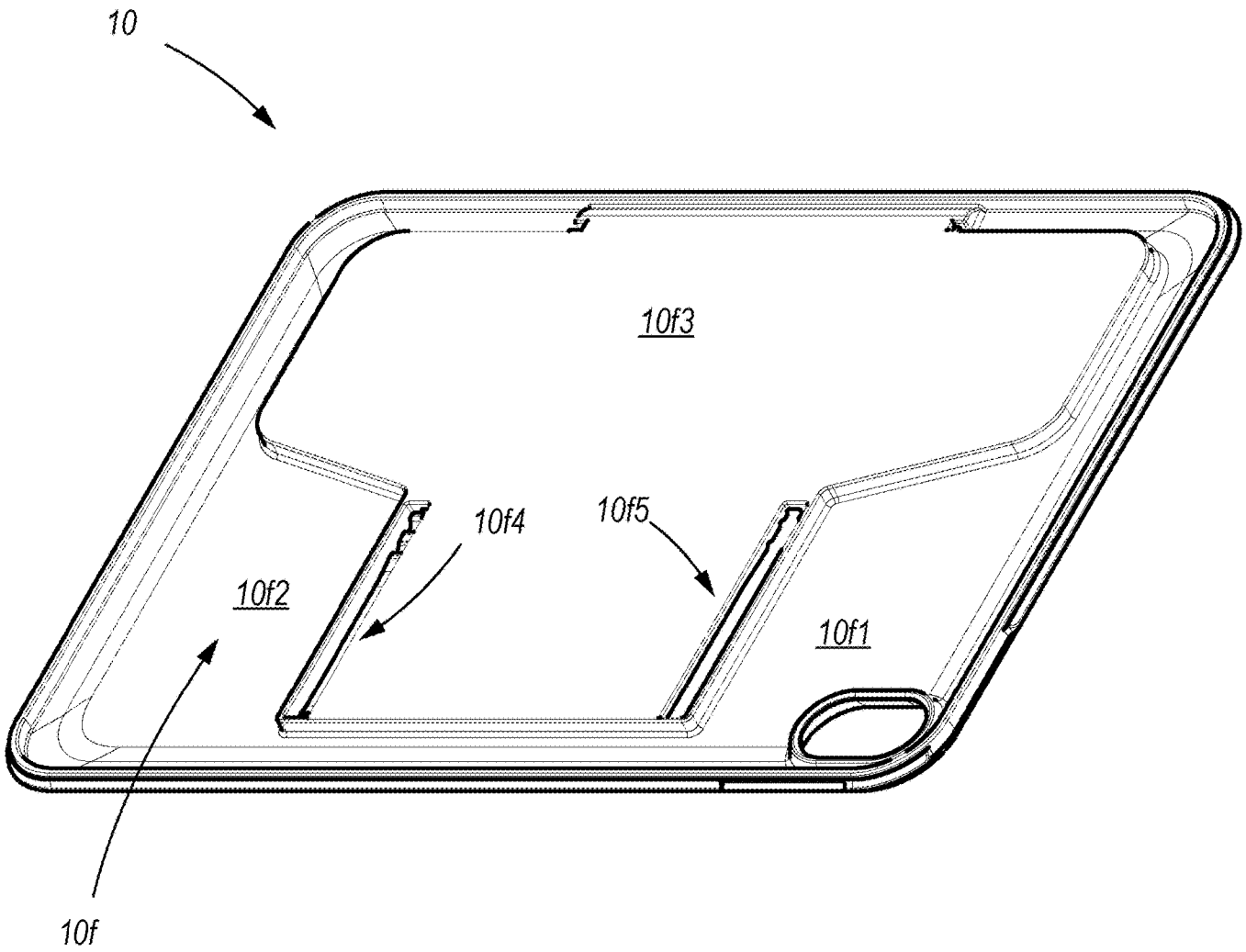

FIG. 9 is a front perspective view of the back member of FIG. 1.

Figure 10:
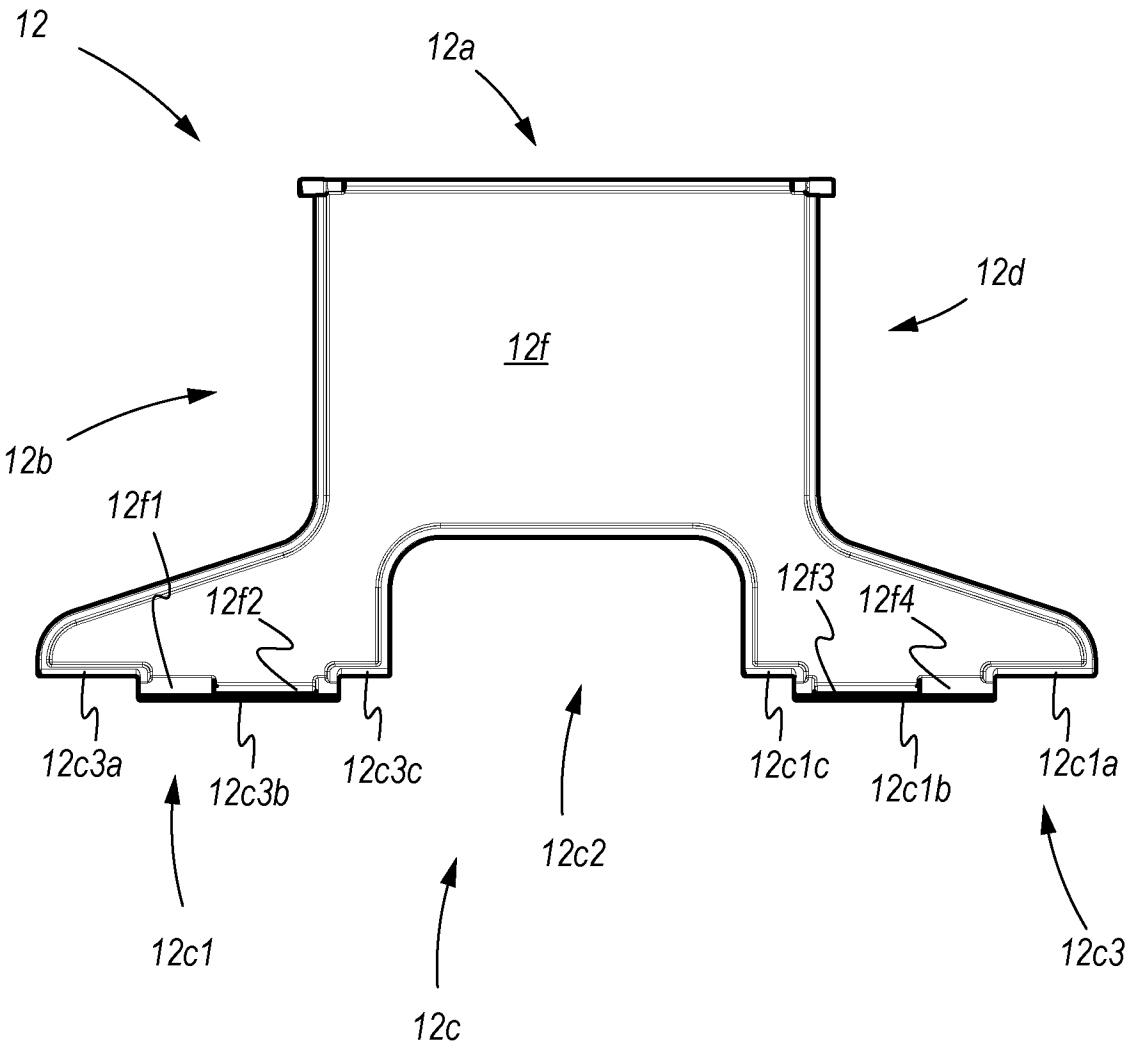

FIG. 10 is a front plan view of the first stand member of FIG. 4.

Figure 11:
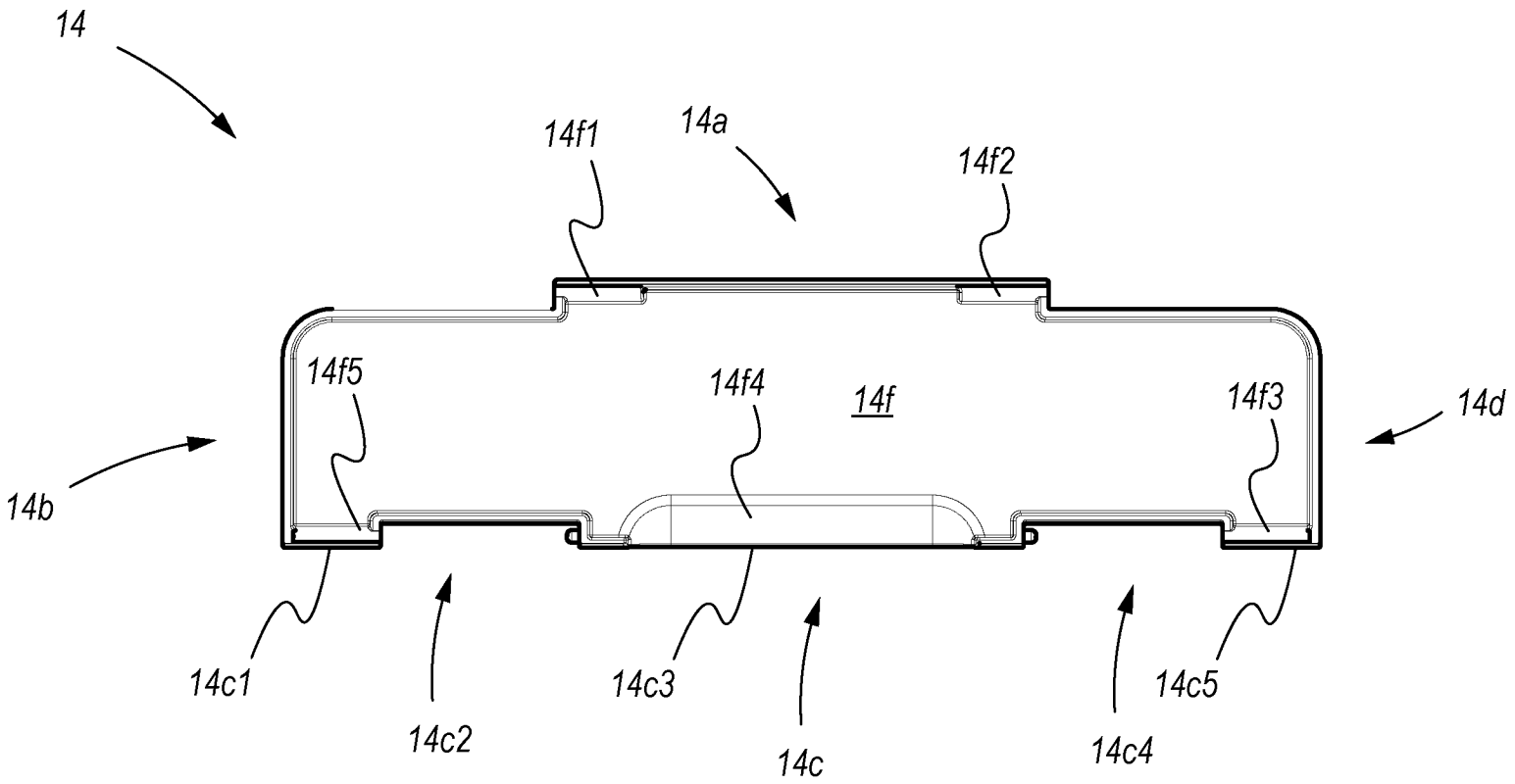

FIG. 11 is a front plan view of the second stand member of FIG. 5.

Figure 12:
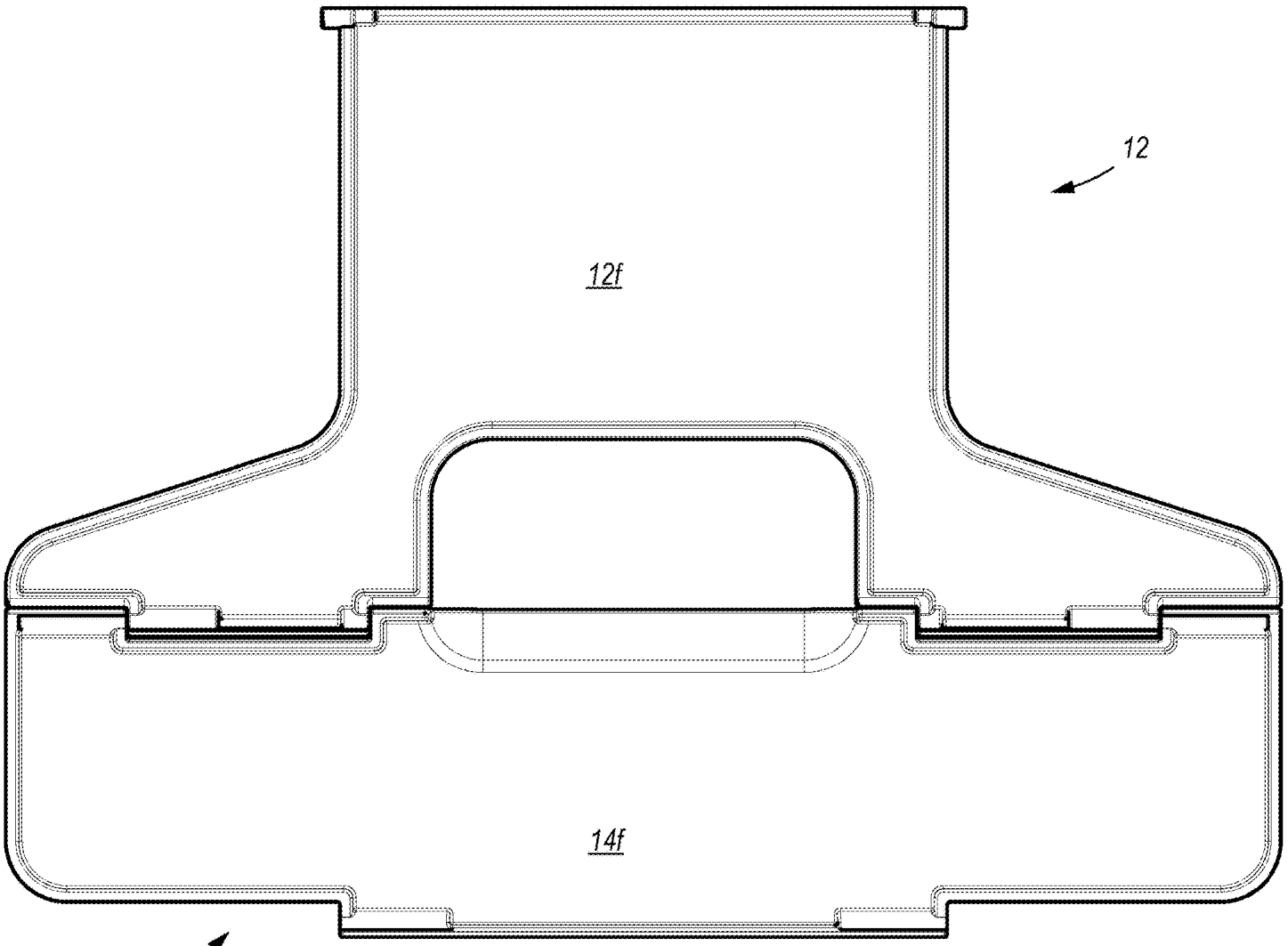

FIG. 12 is a front plan view of the first stand member of FIG. 4 coupled with the second stand member of FIG. 5.

Figure 13:
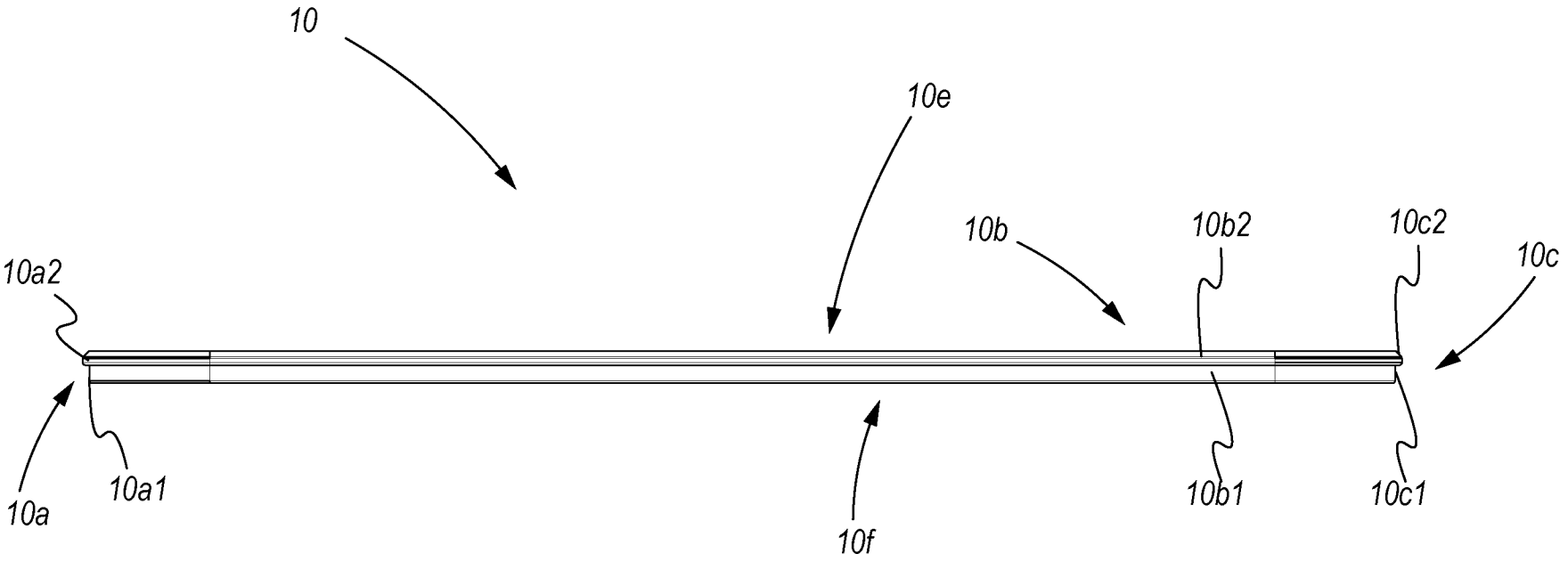

FIG. 13 is a front plan view of the first stand member of FIG. 4 coupled with the second stand member of FIG. 5, and both coupled with the back member of FIG. 1 all of the back assembly.

Figure 14:
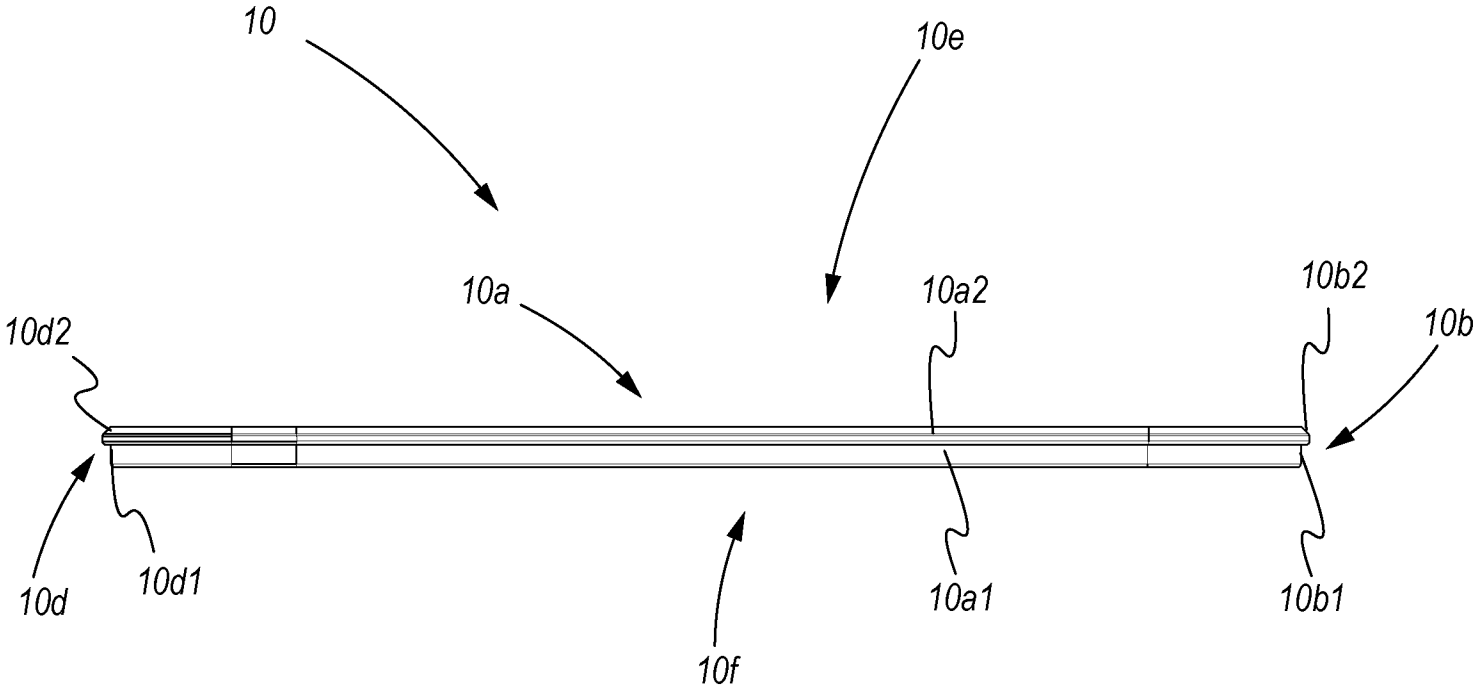

FIG. 14 is a right-side elevational view of the back member of FIG. 1.

Figure 15:
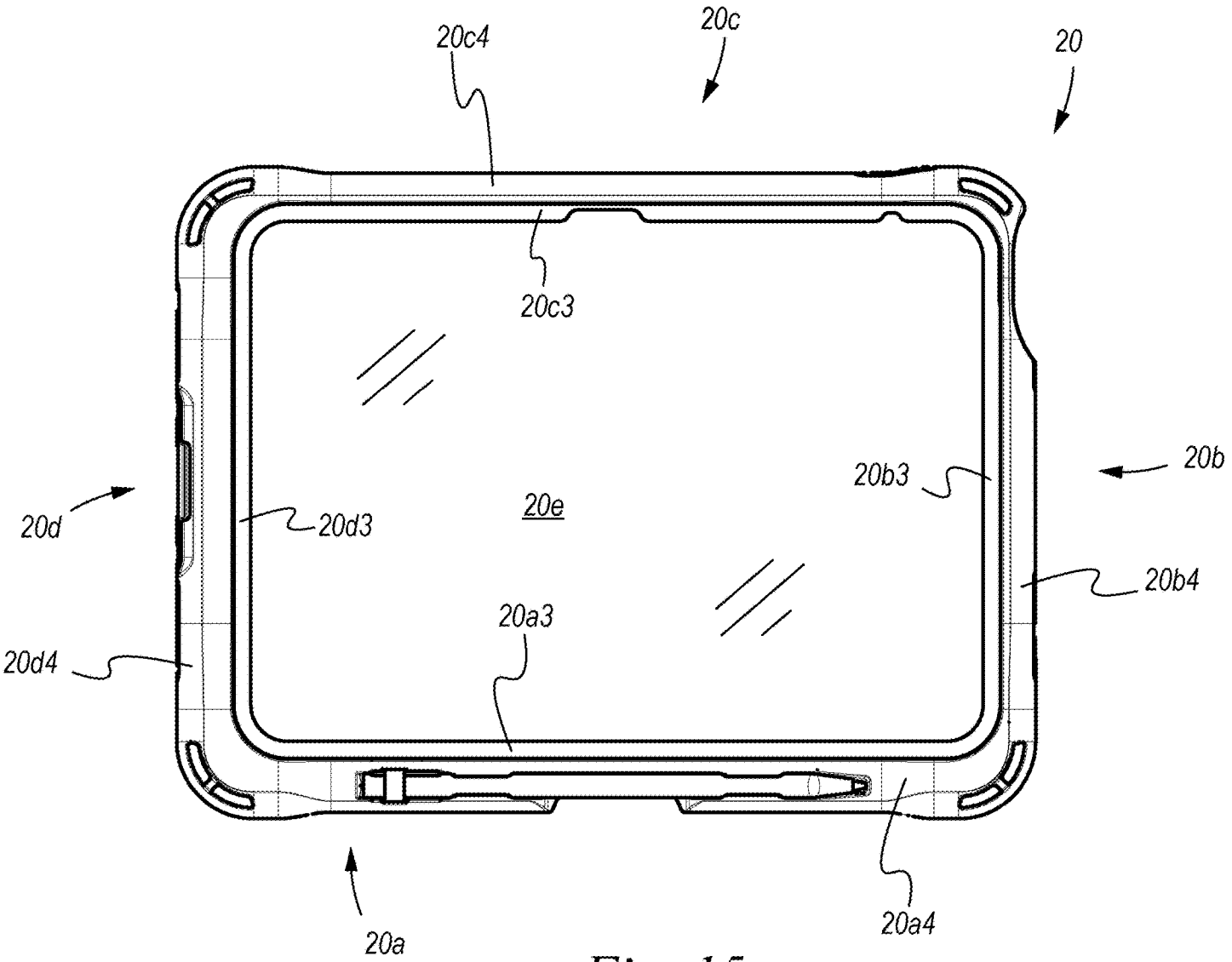

FIG. 15 is a rear plan view of a frame member.

Figure 16:
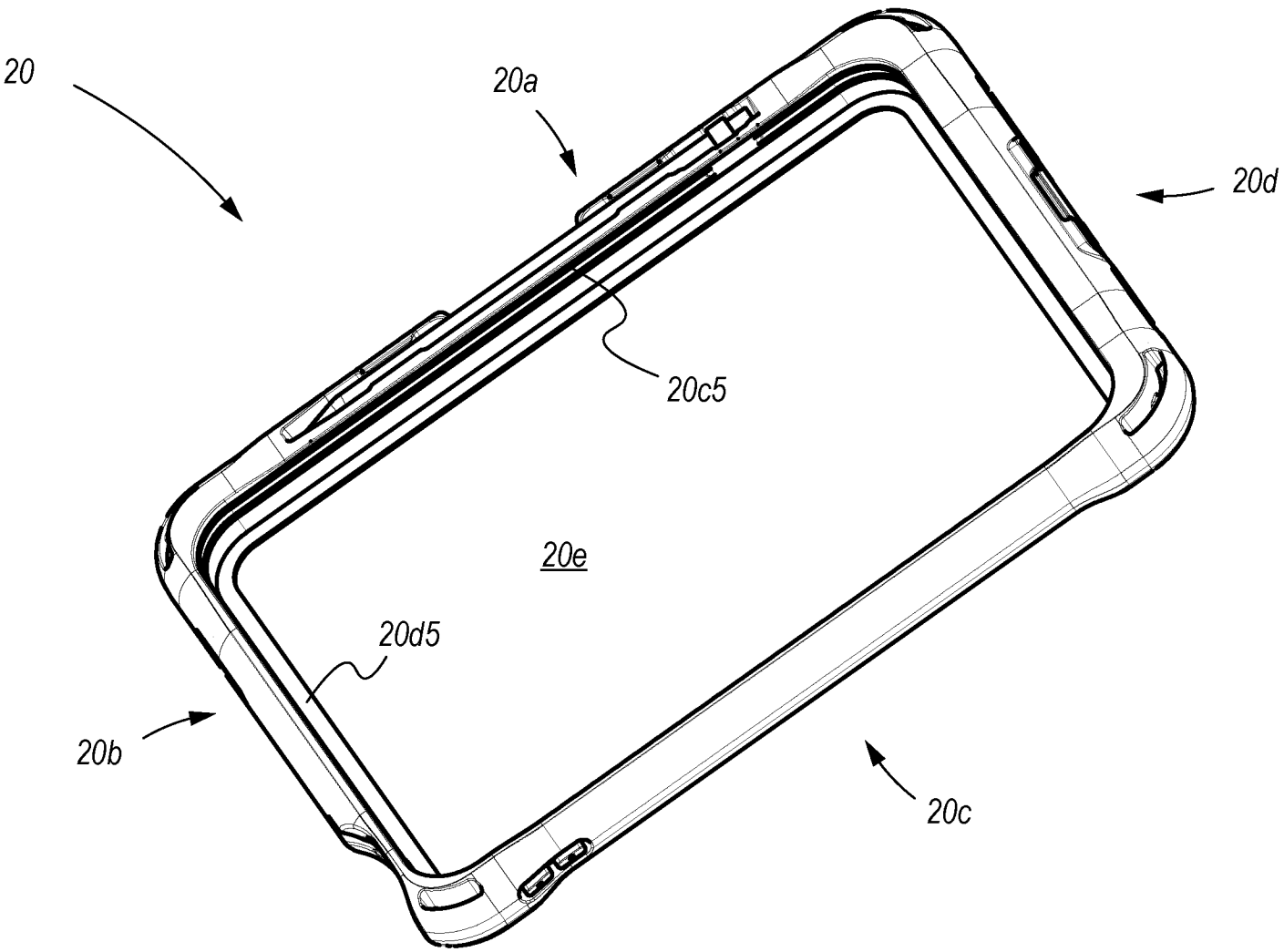

FIG. 16 is a rear perspective view of the frame member of FIG. 15.

Figure 17:
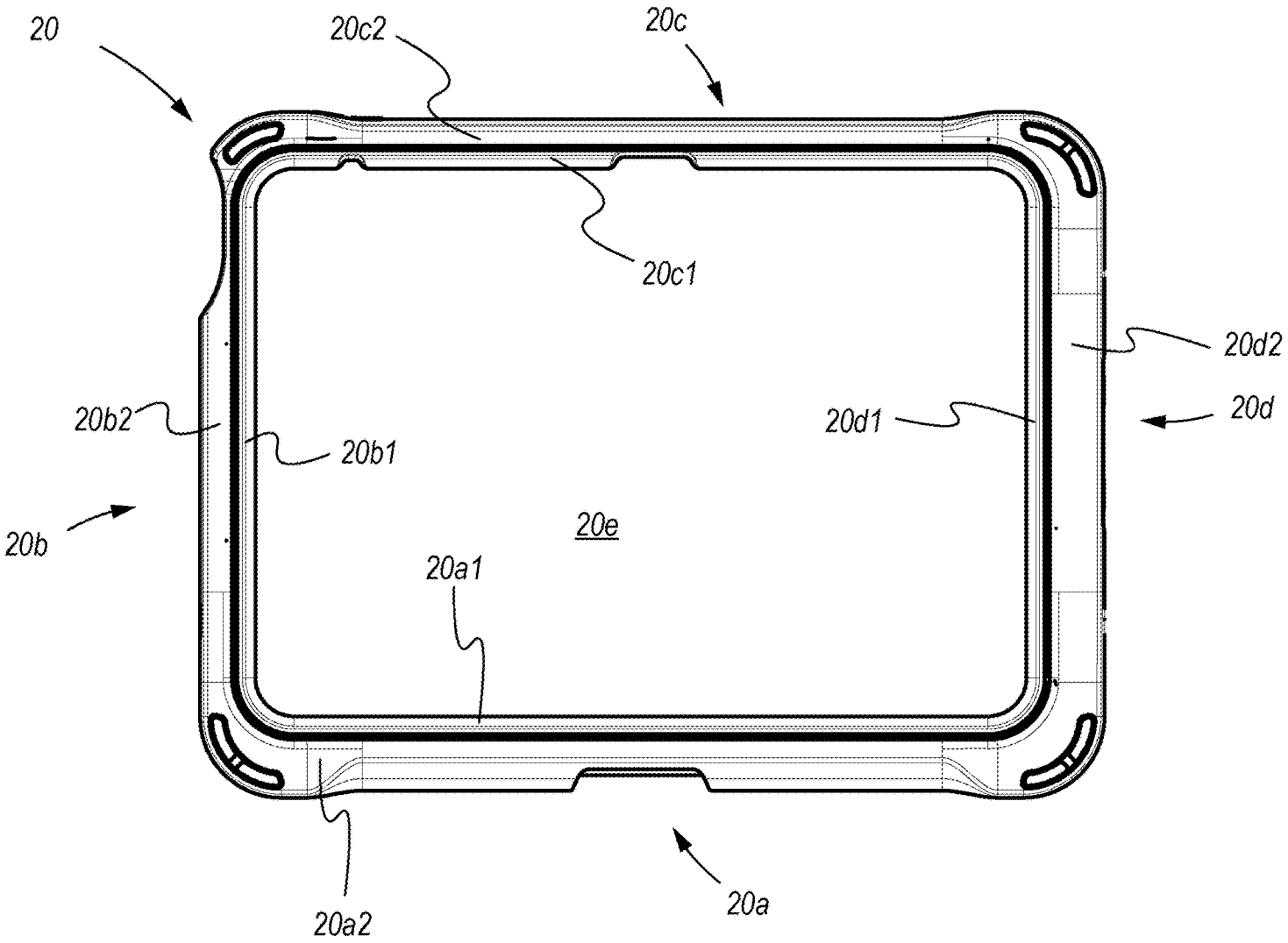

FIG. 17 is a front plan view of the frame member of FIG. 15.

Figure 18:
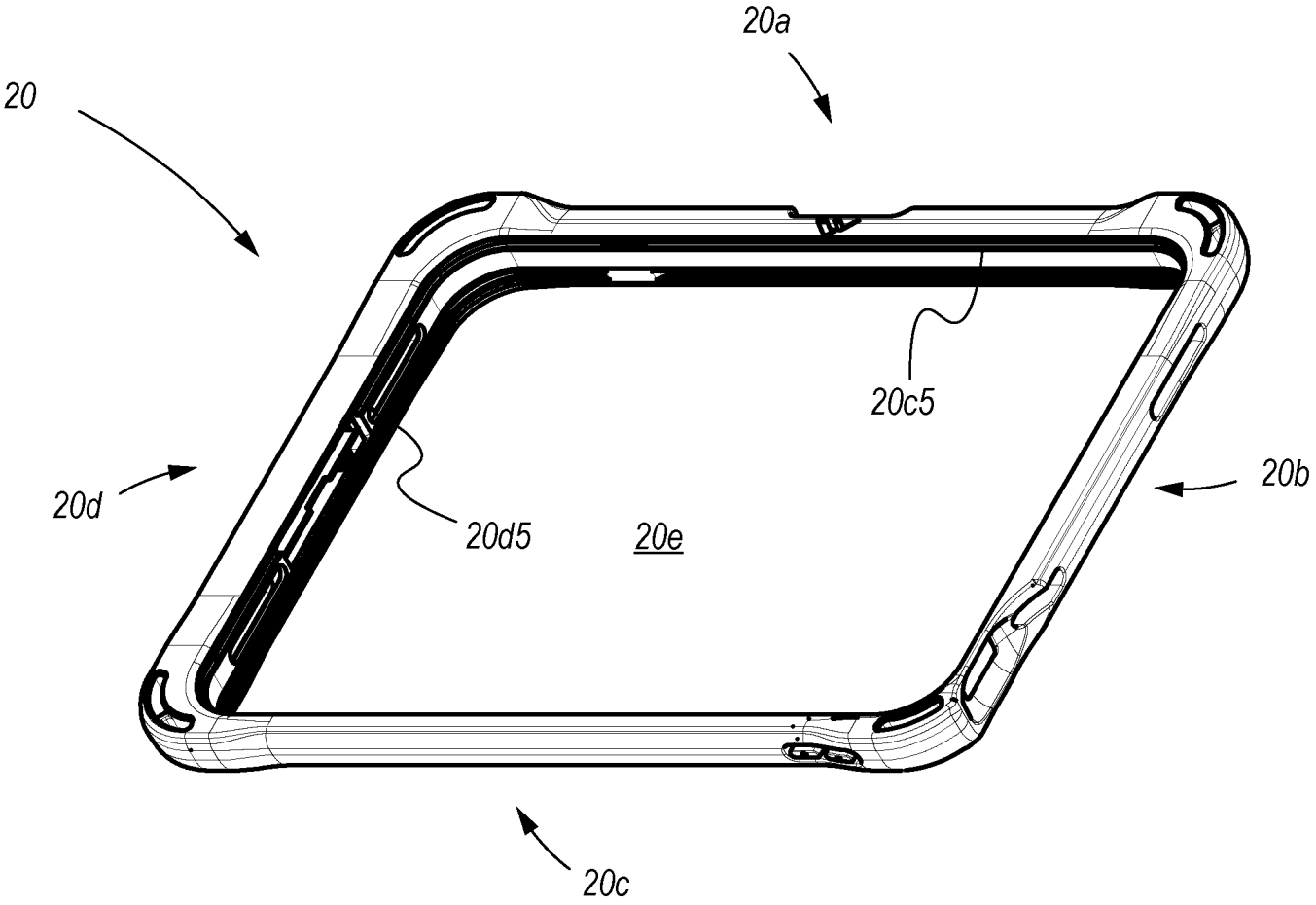

FIG. 18 is a rear perspective view of the frame member of FIG. 15.

Figure 19:
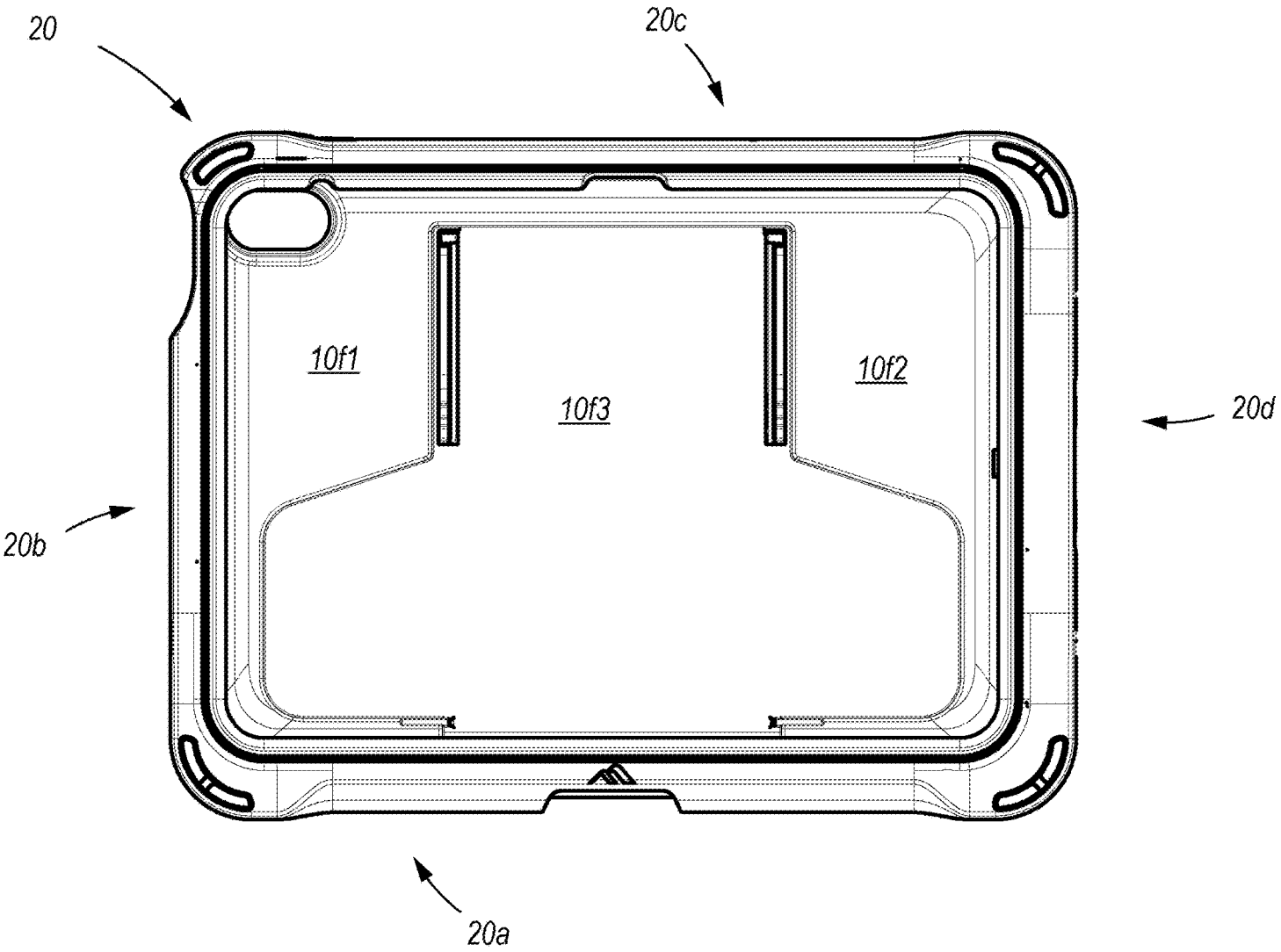

FIG. 19 is a front plan view of the frame member of FIG. 15 coupled with the back member of FIG. 1.

Figure 20:
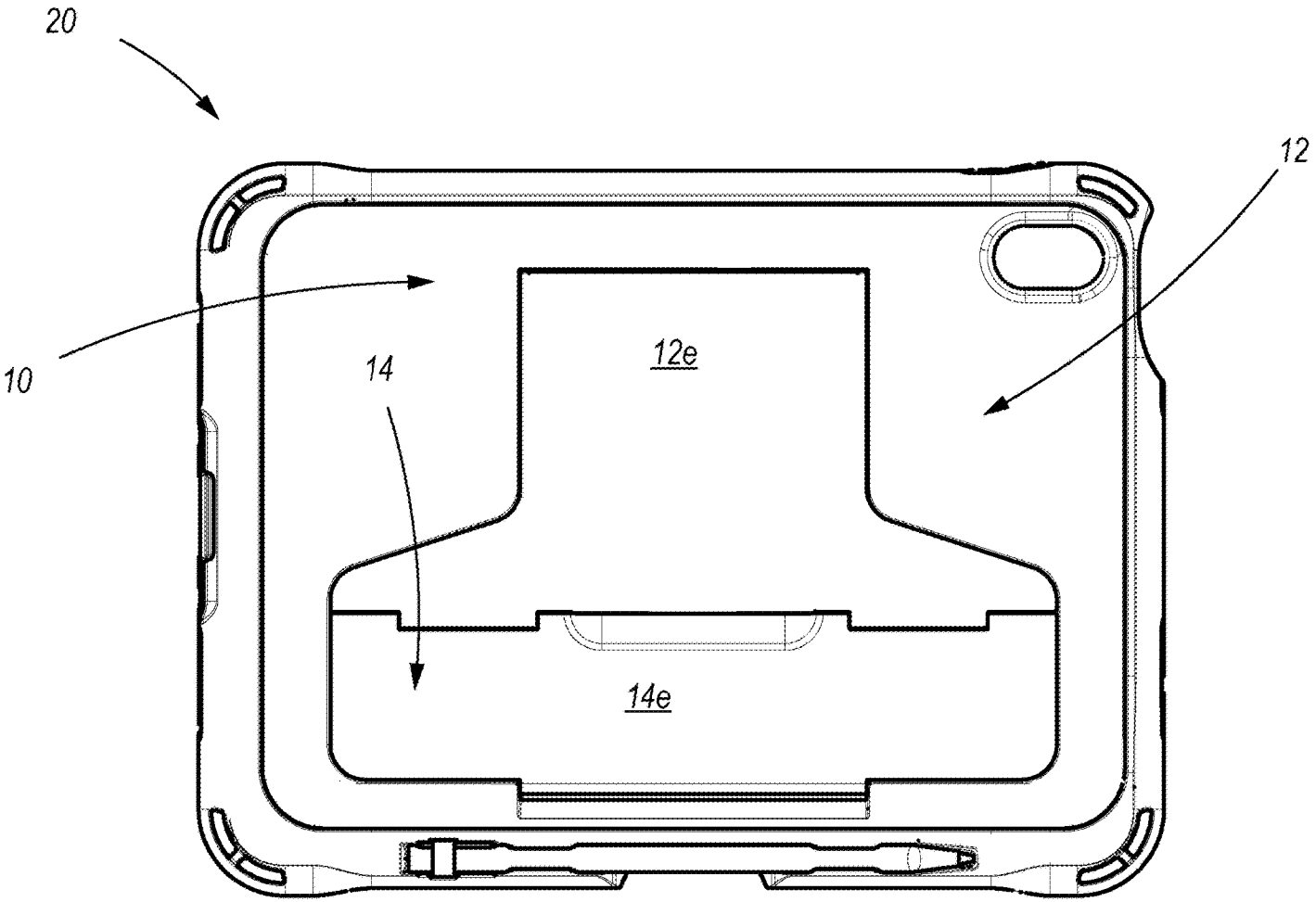

FIG. 20 is a rear plan view of the first stand member of FIG. 4 coupled with the second stand member of FIG. 5, and both coupled with the back member of FIG. 1 of the back assembly, coupled with the frame member of FIG. 15.

Figure 21:
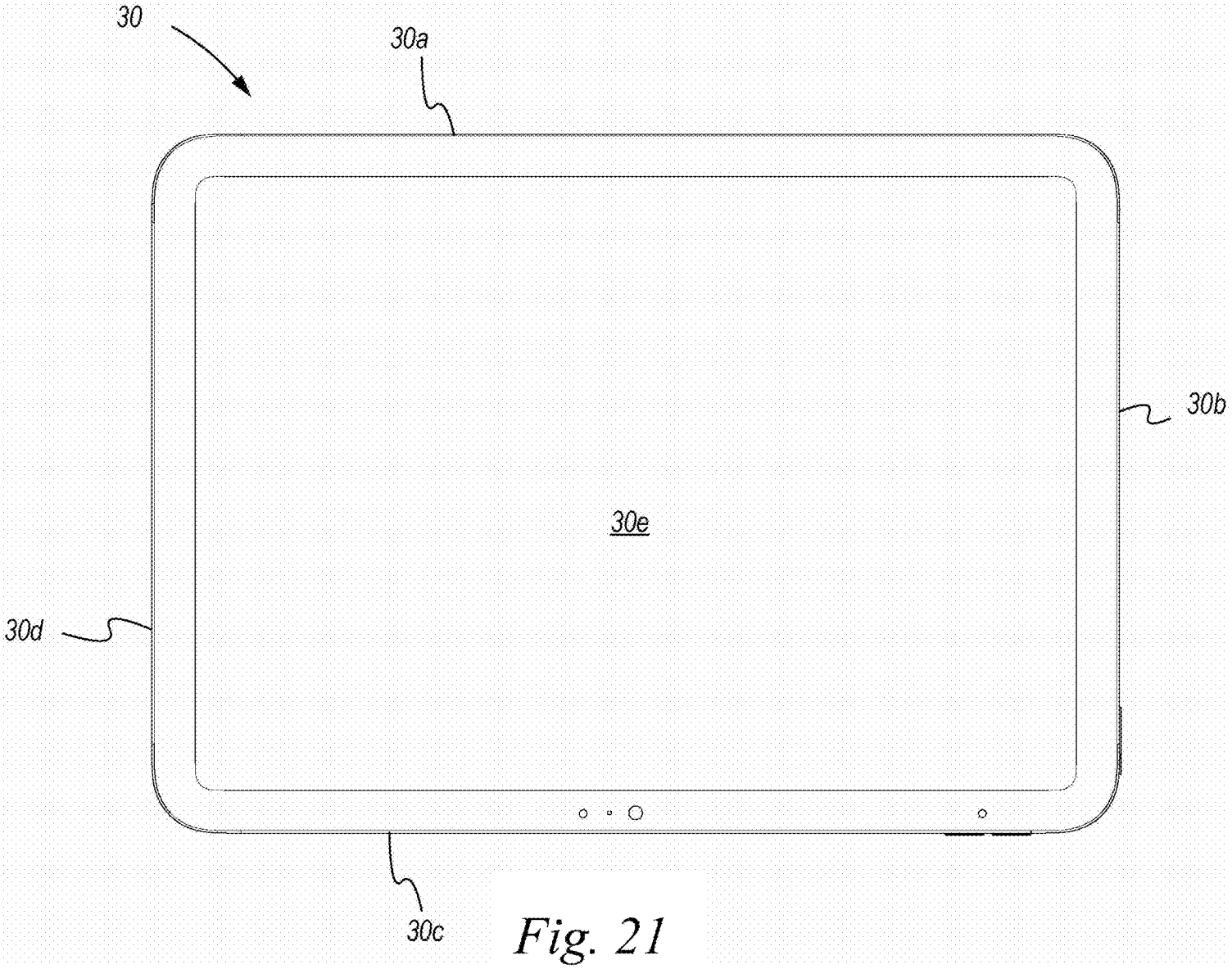

FIG. 21 is a front elevational view of a portable electronic device.

Figure 22:
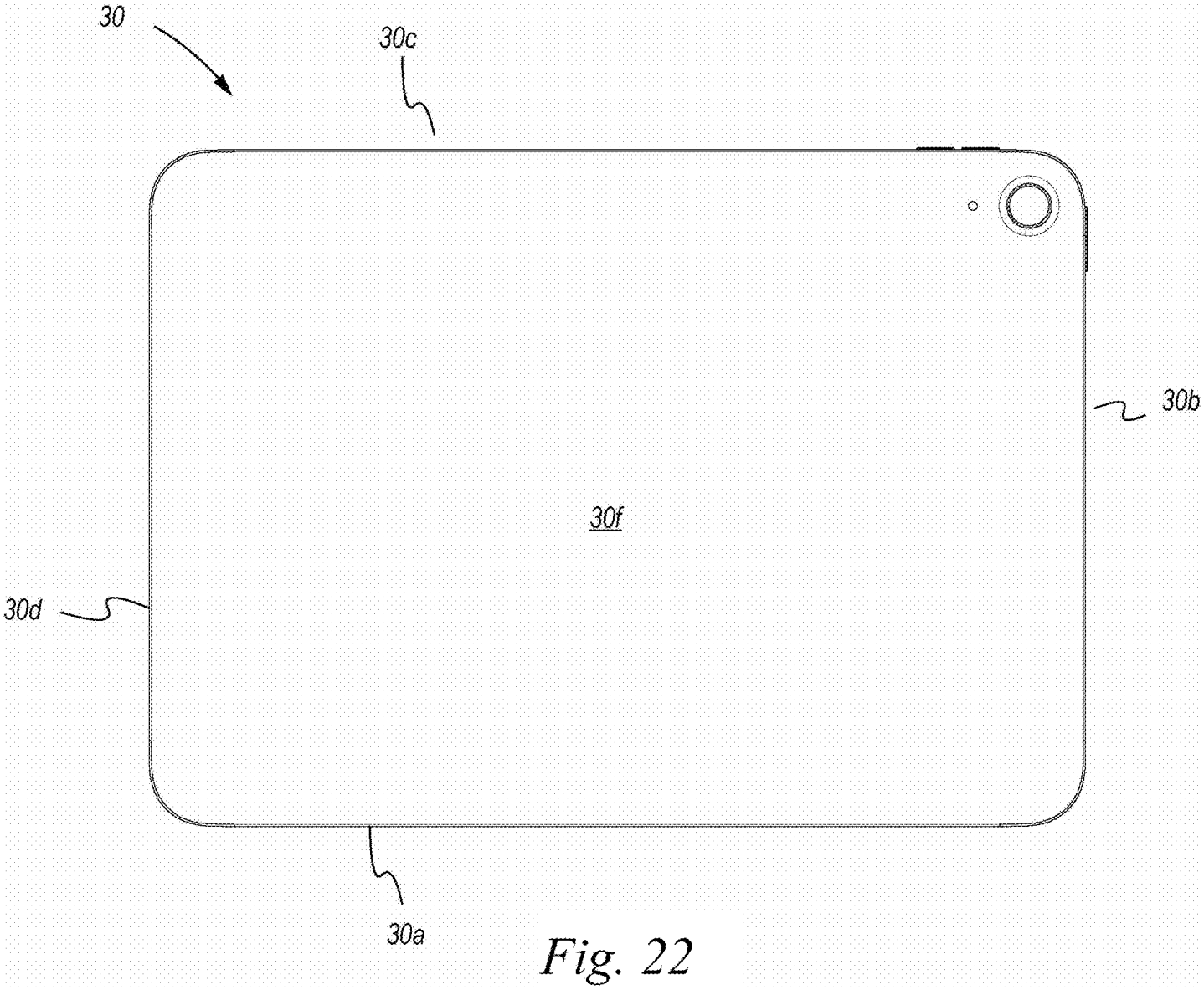

FIG. 22 is a rear elevational view of the portable electronic device of FIG. 21.

Figure 23:
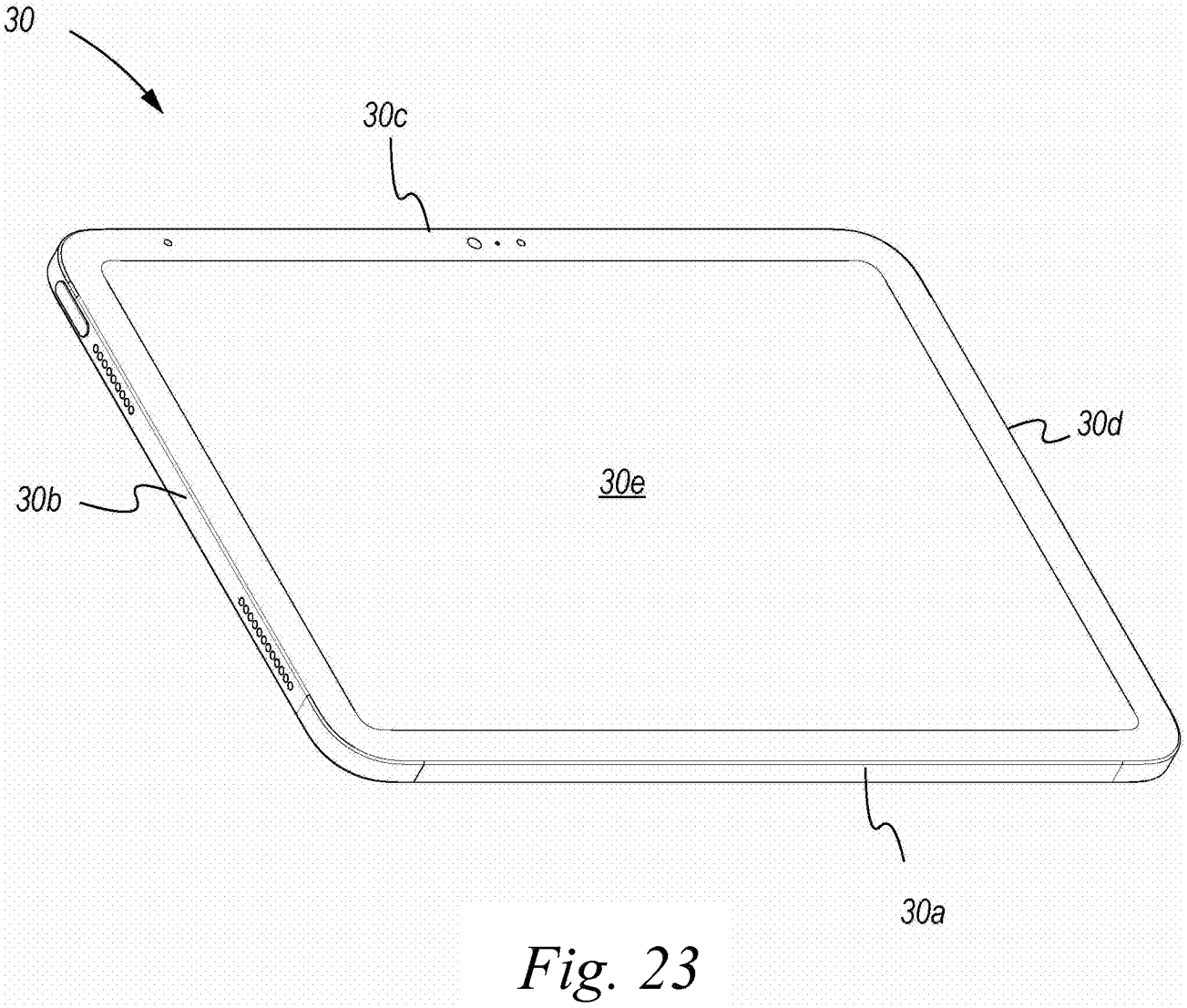

FIG. 23 is a front-right-top isometric view of the portable electronic device of FIG. 21.

Figure 24:
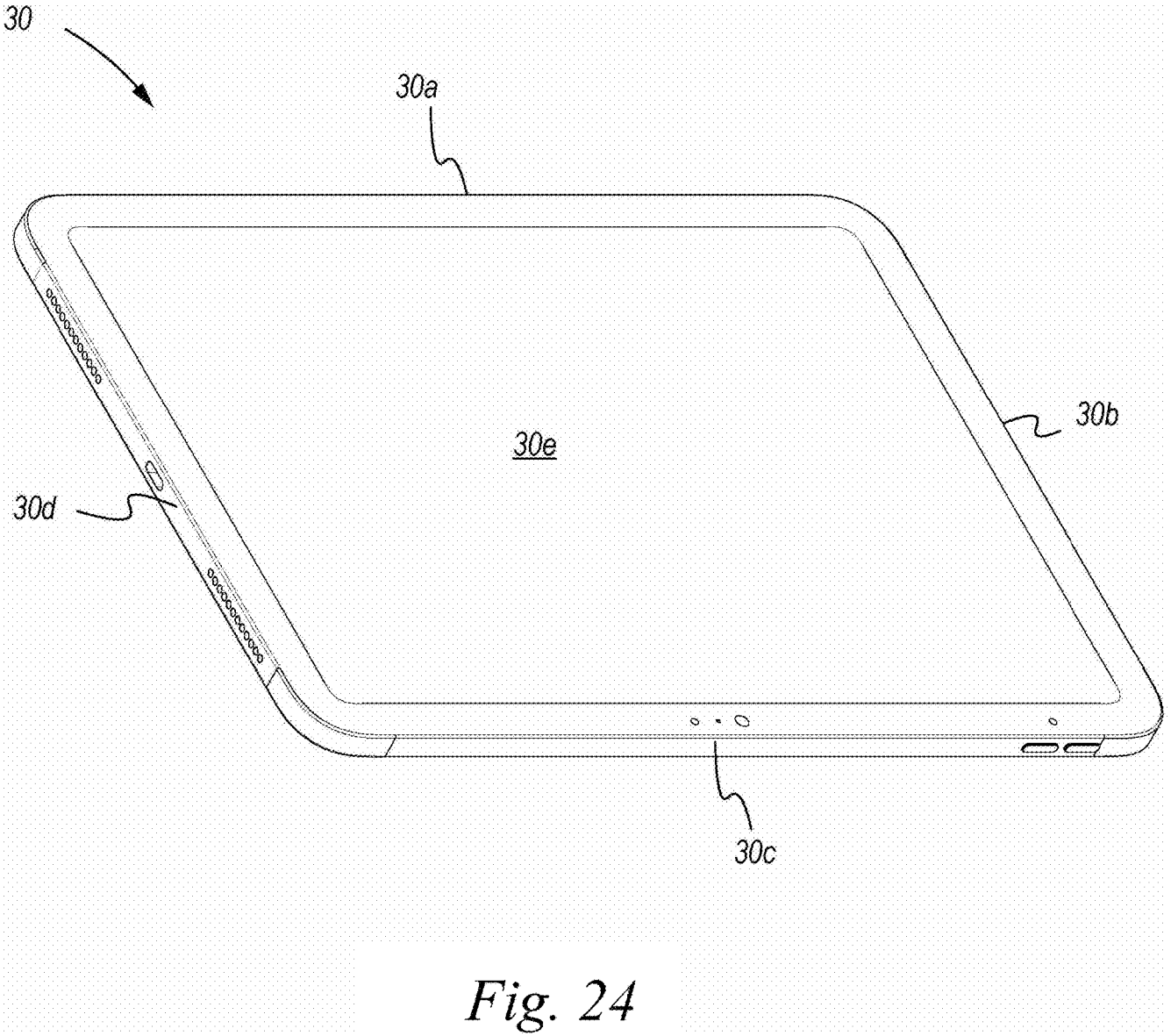

FIG. 24 is a front-left-top isometric view of the portable electronic device of FIG. 21.

Figure 25:
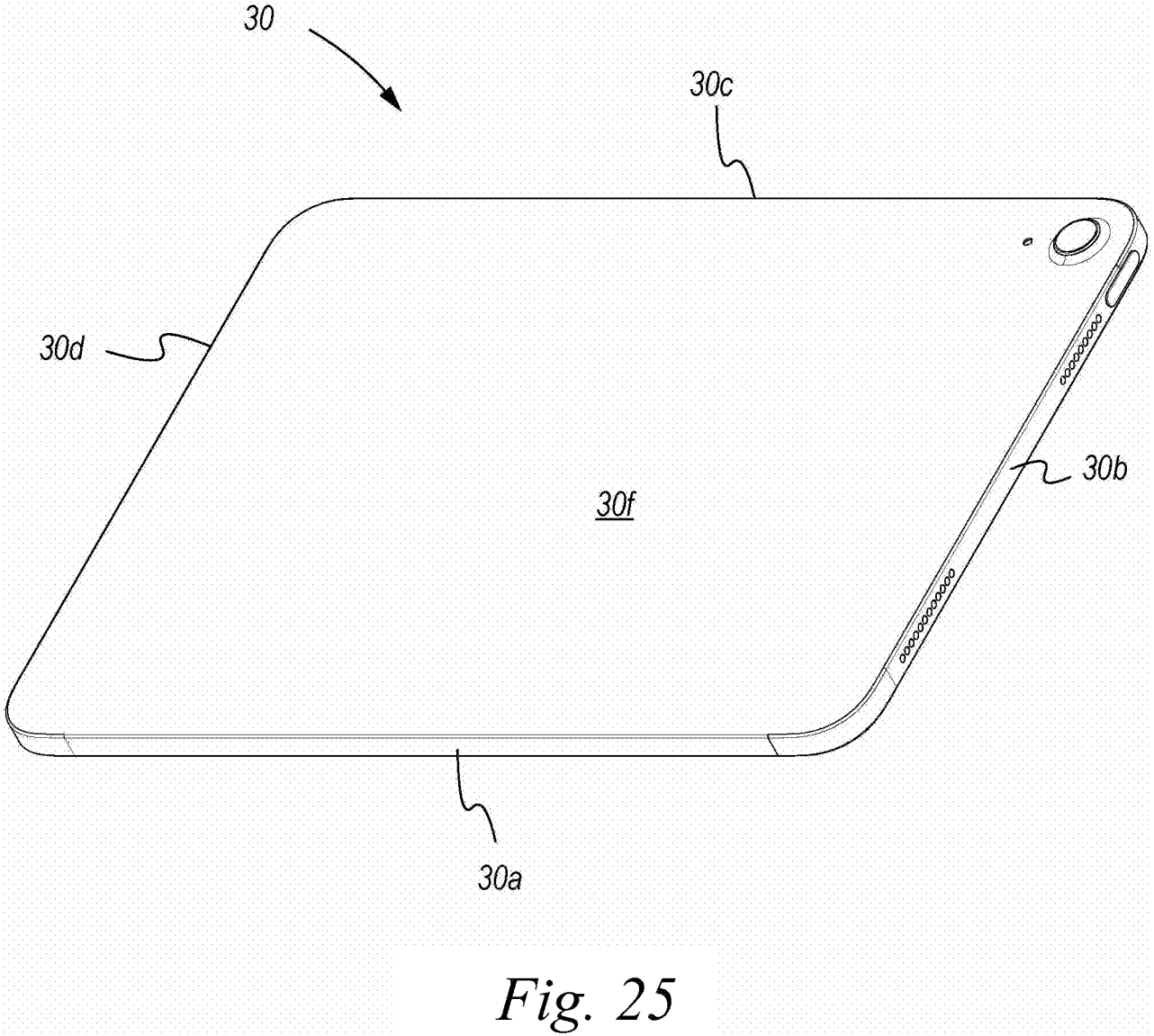

FIG. 25 is a back-left-top isometric view of the portable electronic device of FIG. 21.

Figure 26:
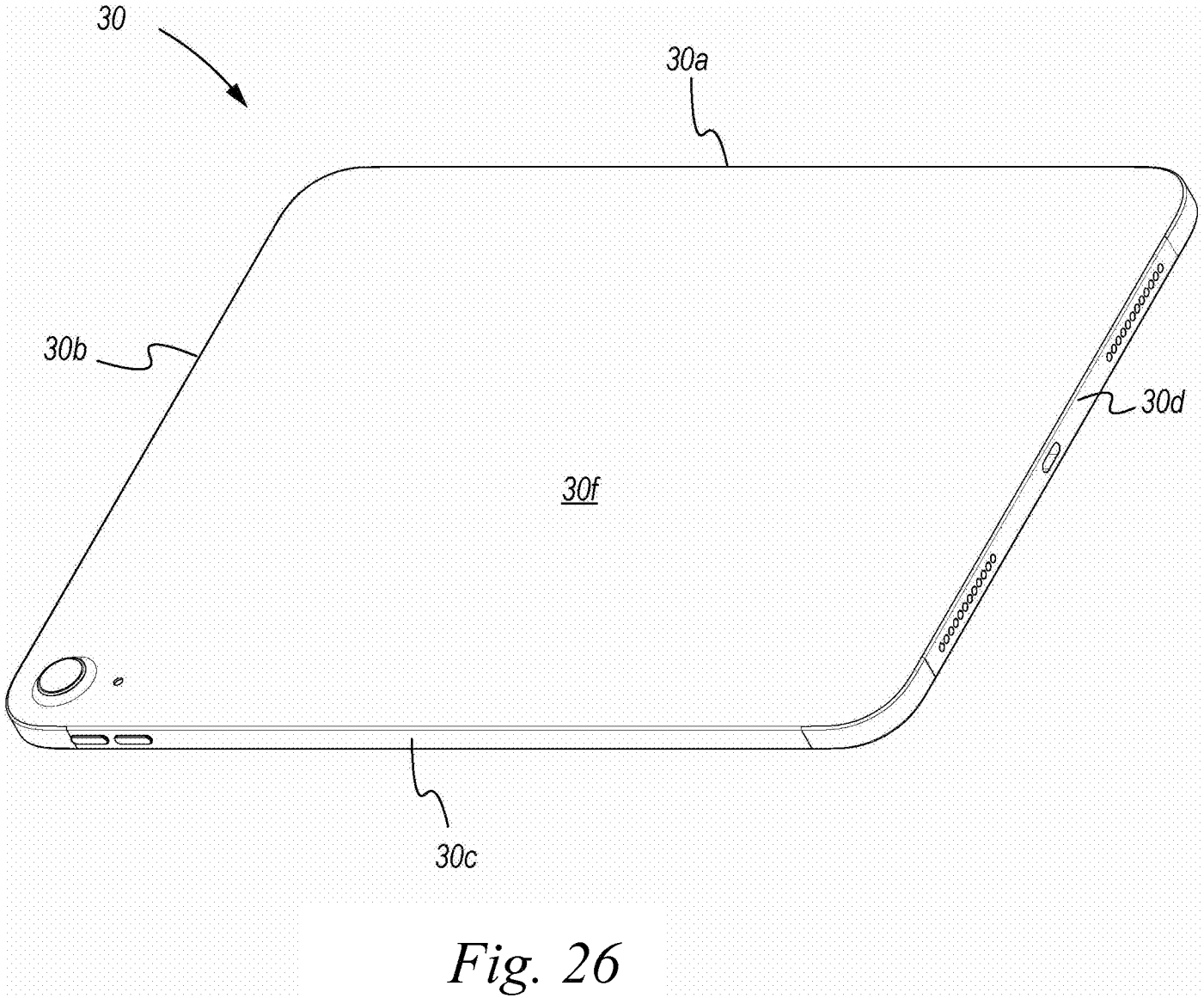

FIG. 26 is a front-right-bottom isometric view of the portable electronic device of FIG. 21.

Figure 27:
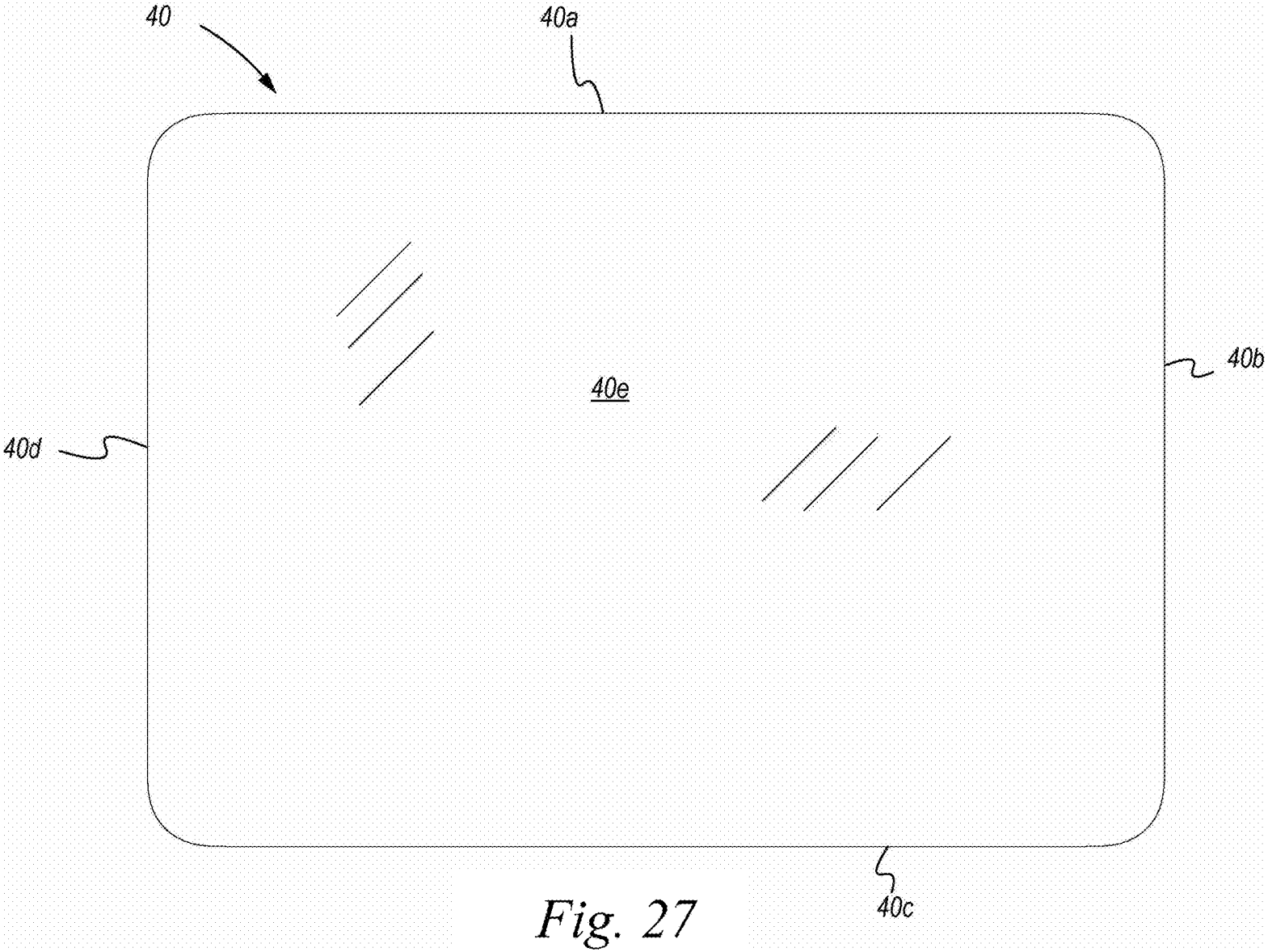

FIG. 27 is a front elevational view of a sheet member.

Figure 28:
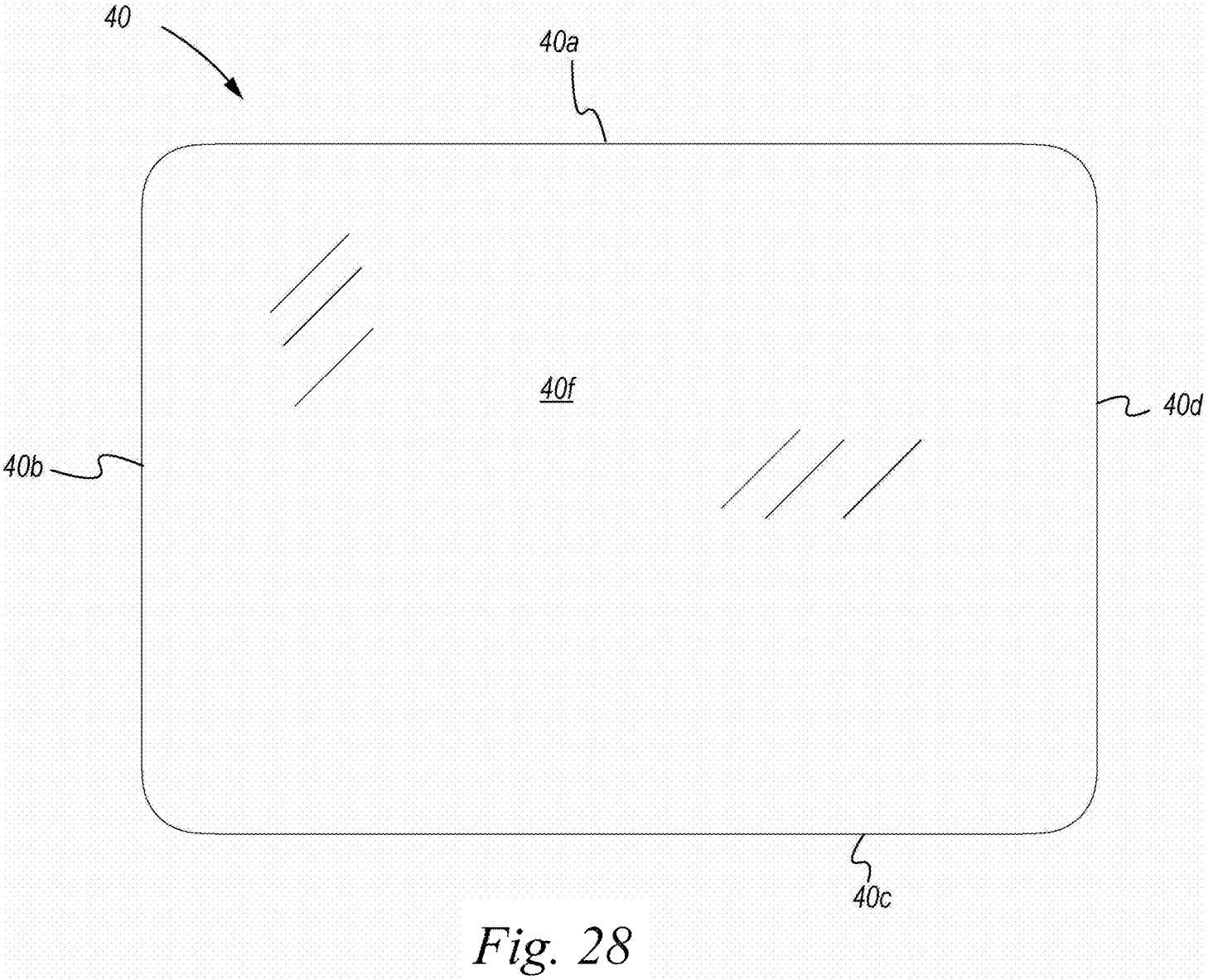

FIG. 28 is a rear elevational view of the sheet member of FIG. 27.

Figure 29:
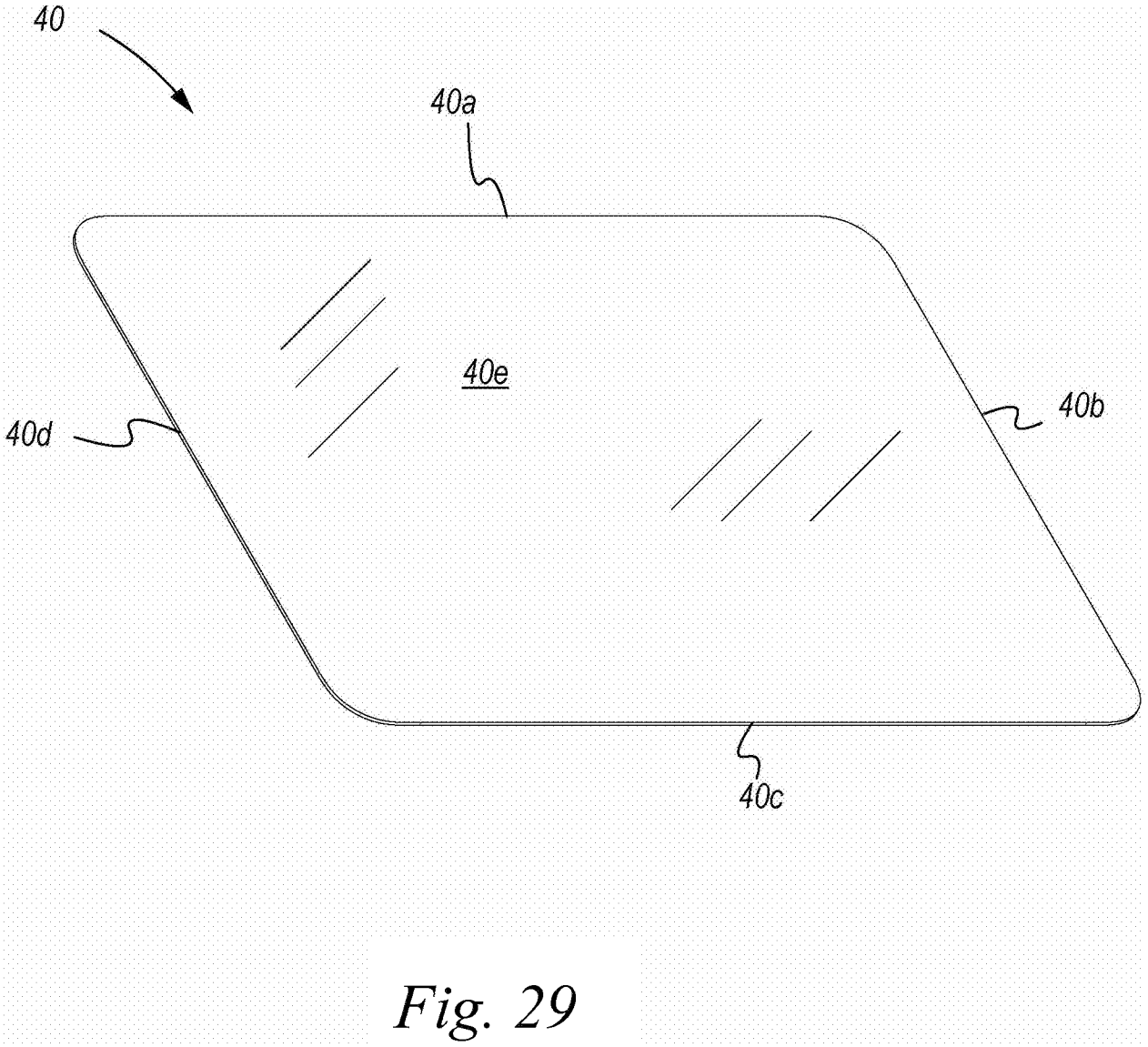

FIG. 29 is a back-right-top isometric view of the sheet member of FIG. 27.

Figure 30:
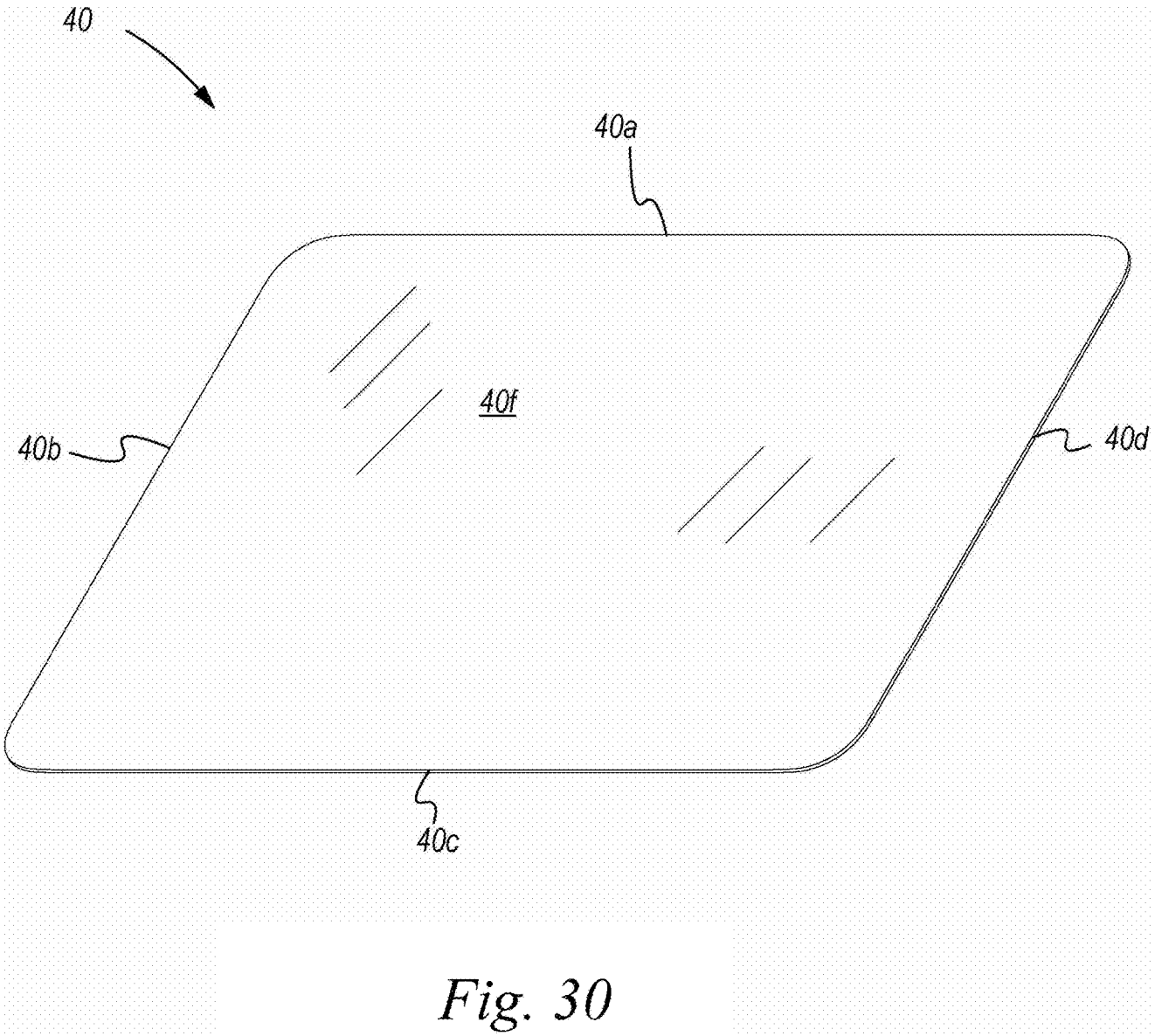

FIG. 30 is a back-left-top isometric view of the sheet member of FIG. 27.

Figure 31:
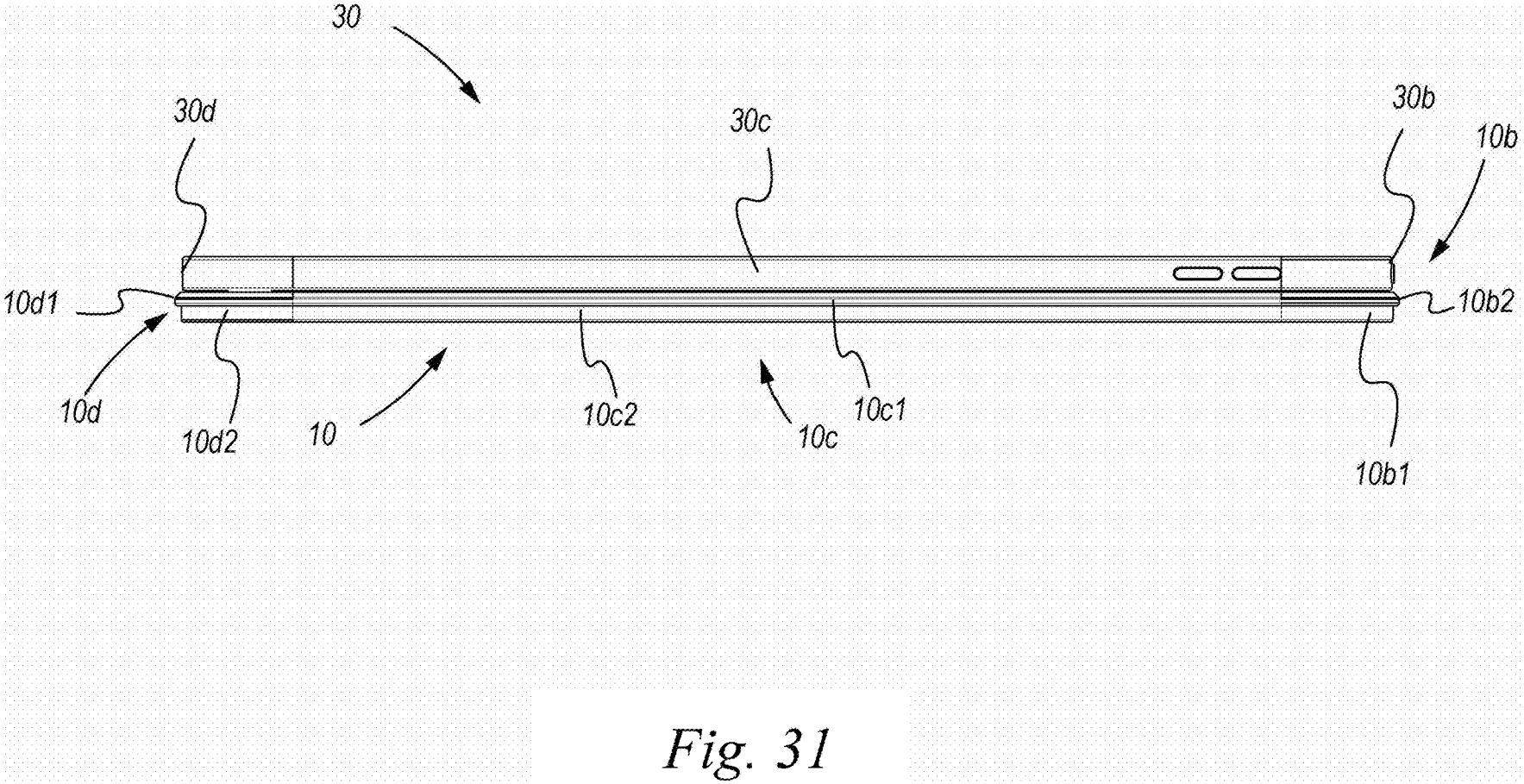

FIG. 31 is a right side elevational view of the back member of FIG. 1 coupled with the portable electronic device of FIG. 27.

Figure 32:
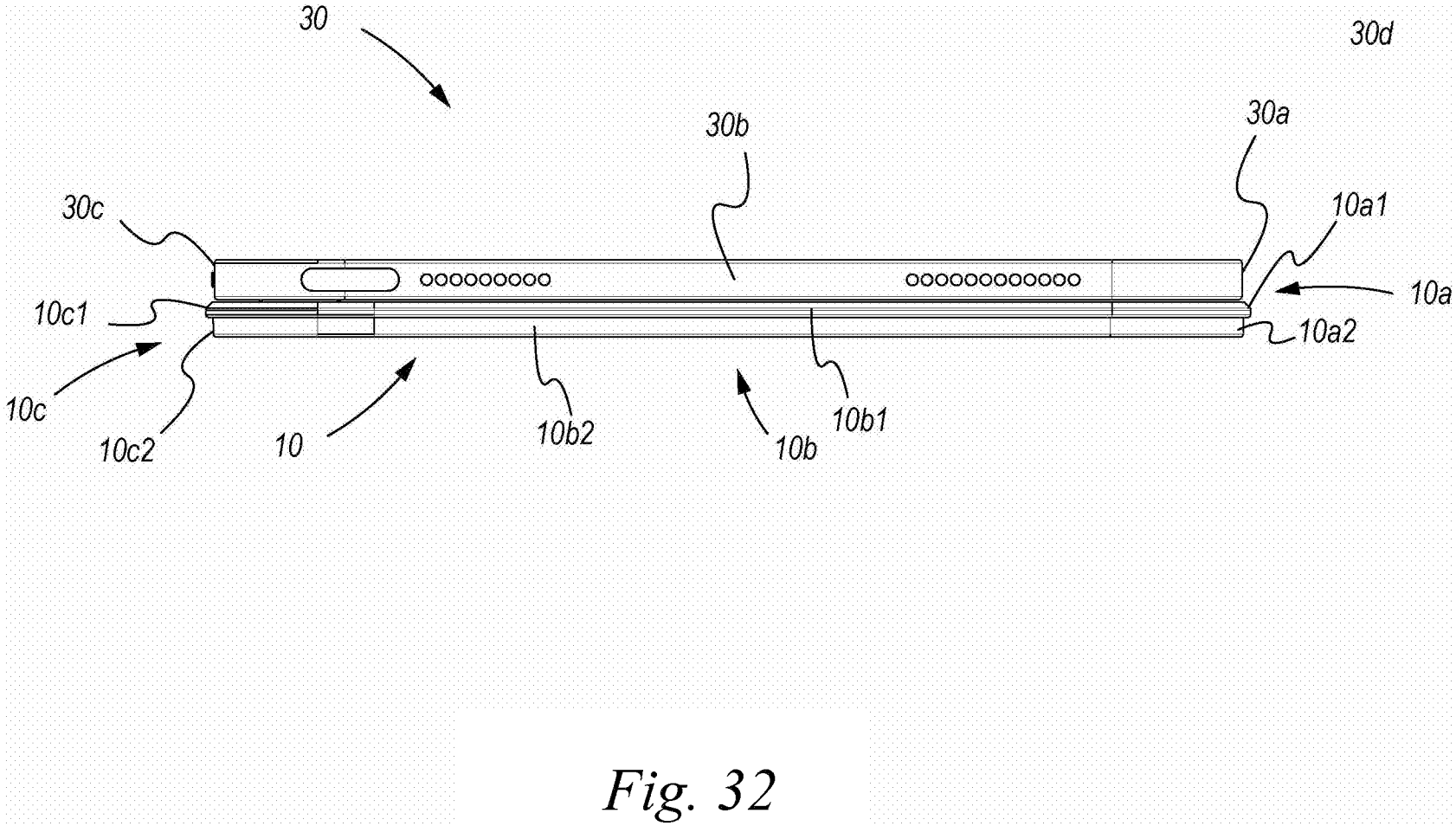

FIG. 32 is a top plan view of the back member of FIG. 1 coupled with the portable electronic device of FIG. 27.

Figure 33:
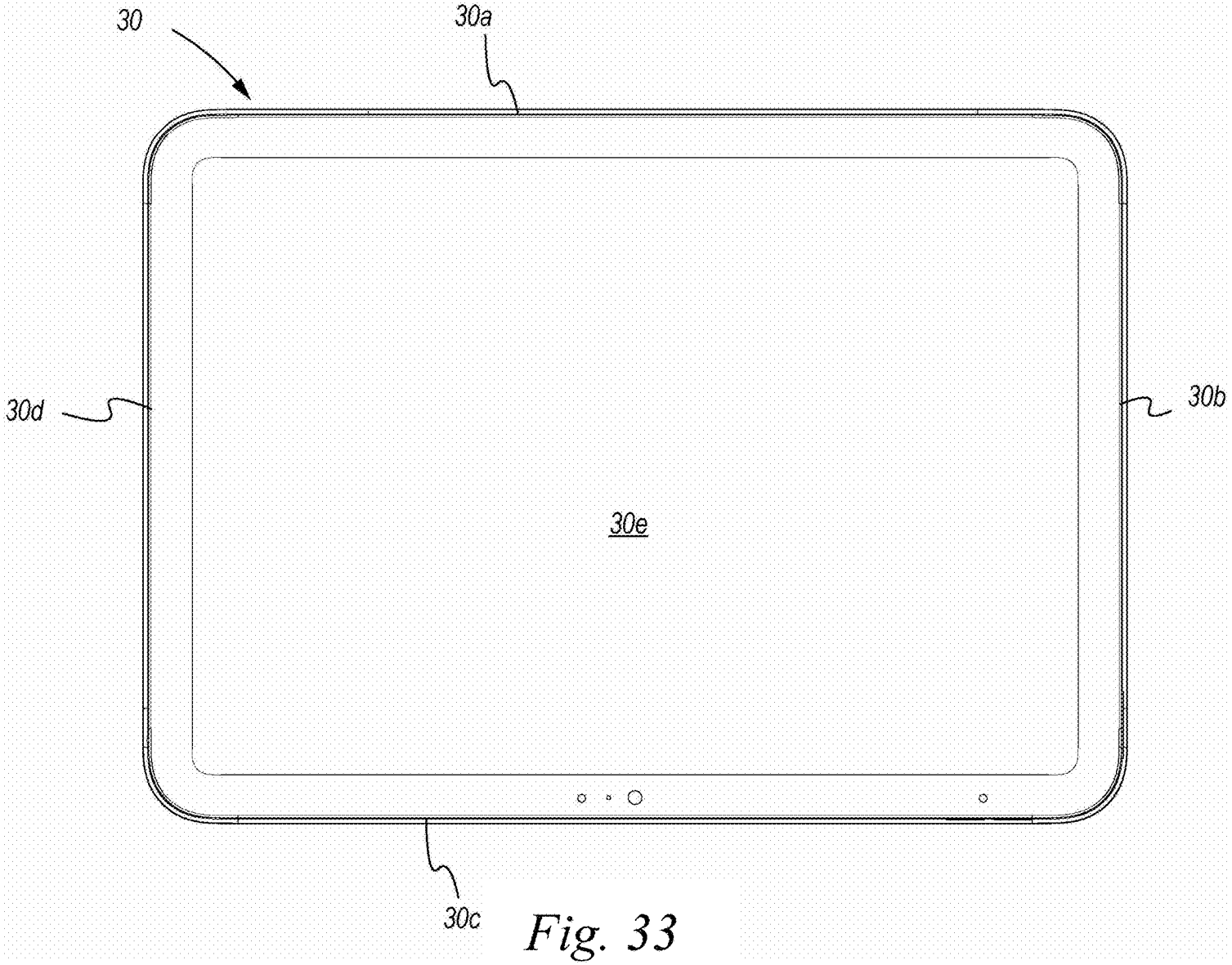

FIG. 33 is a front elevational view of the back member of FIG. 1 coupled with the portable electronic device of FIG. 27.

Figure 34:
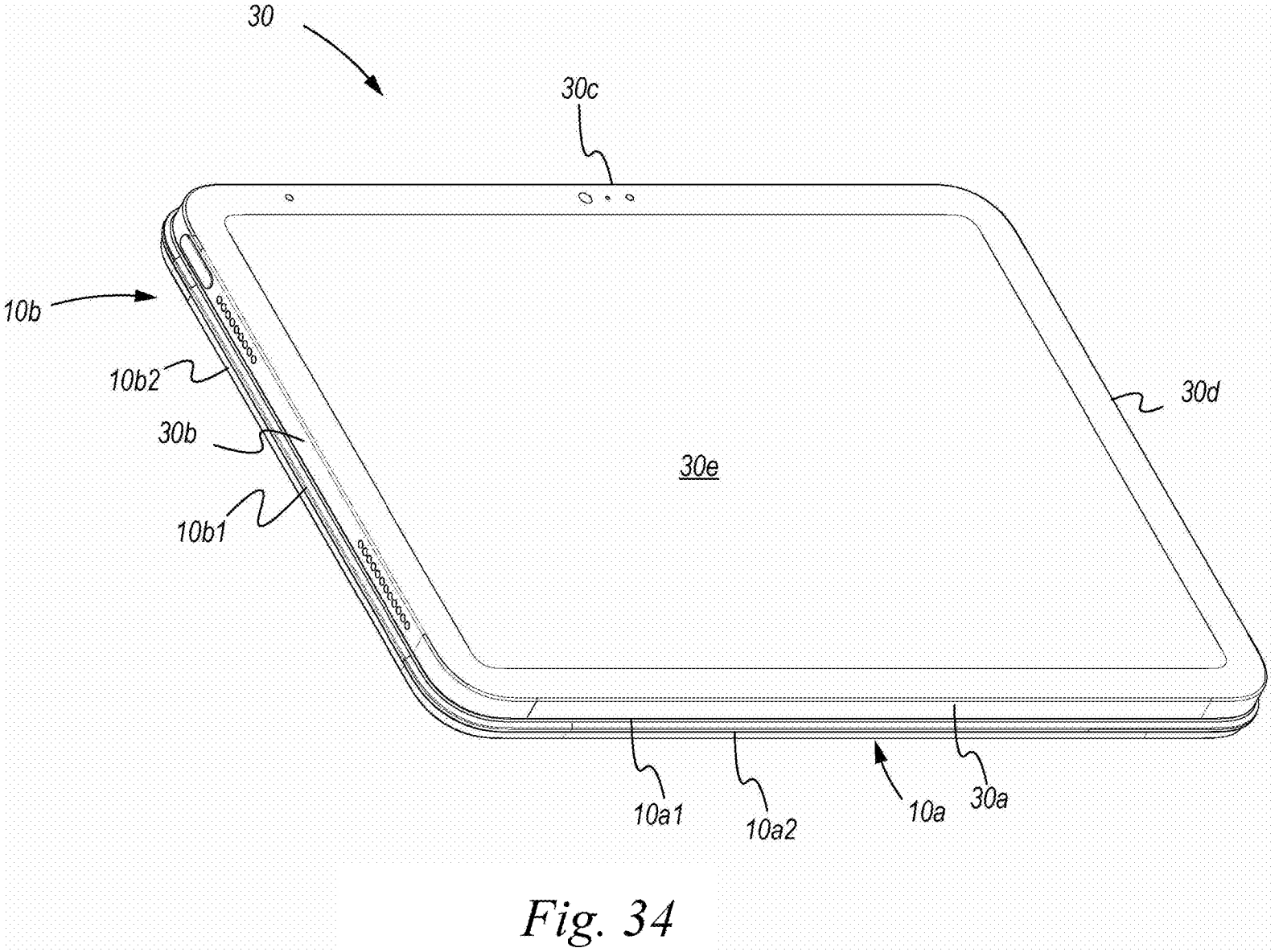

FIG. 34 is a back-right-top isometric view of the back member of FIG. 1 coupled with the portable electronic device of FIG. 27.

Figure 35:
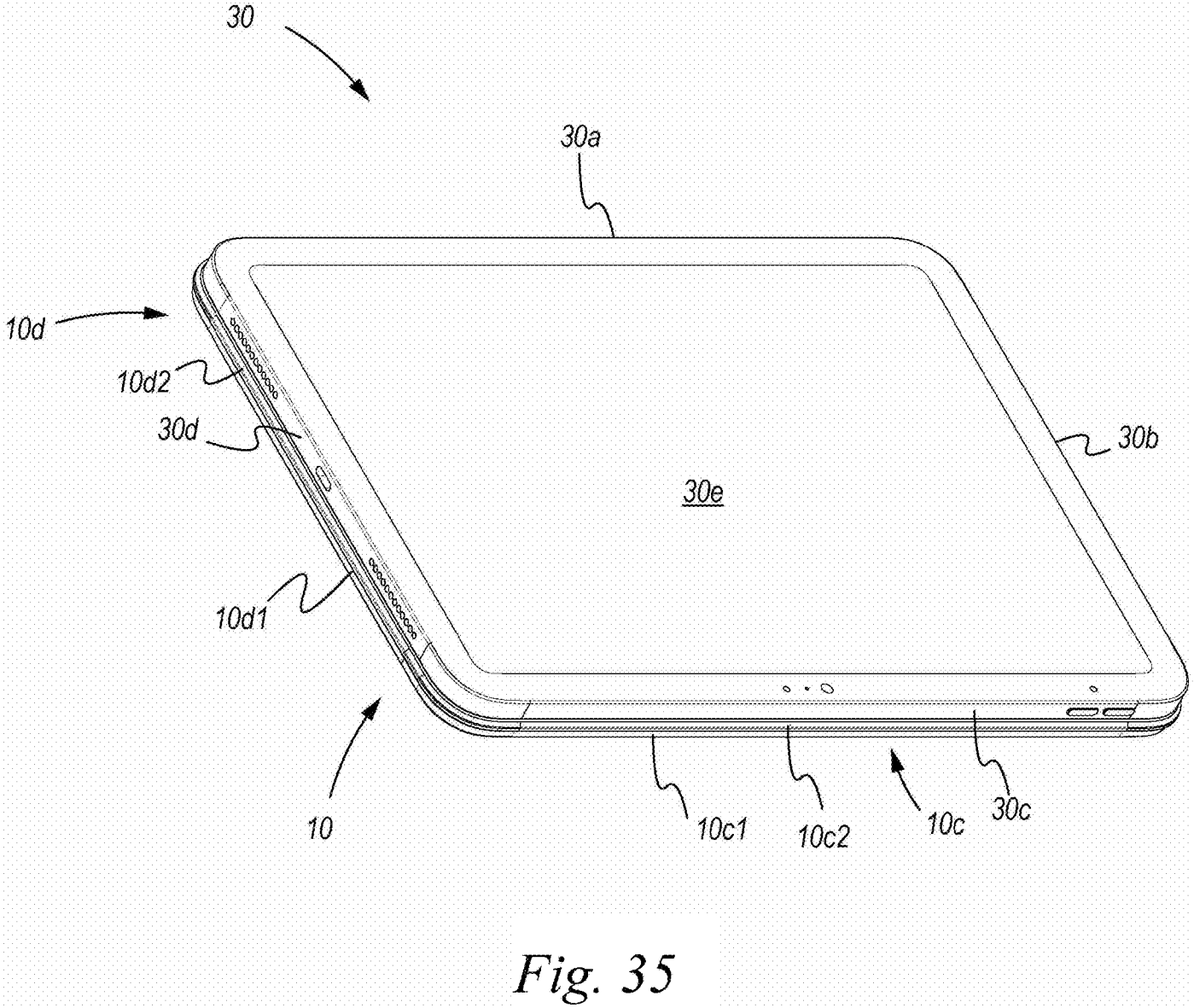

FIG. 35 is a front-left-top isometric view of the back member of FIG. 1 coupled with the portable electronic device of FIG. 27.

Figure 36:
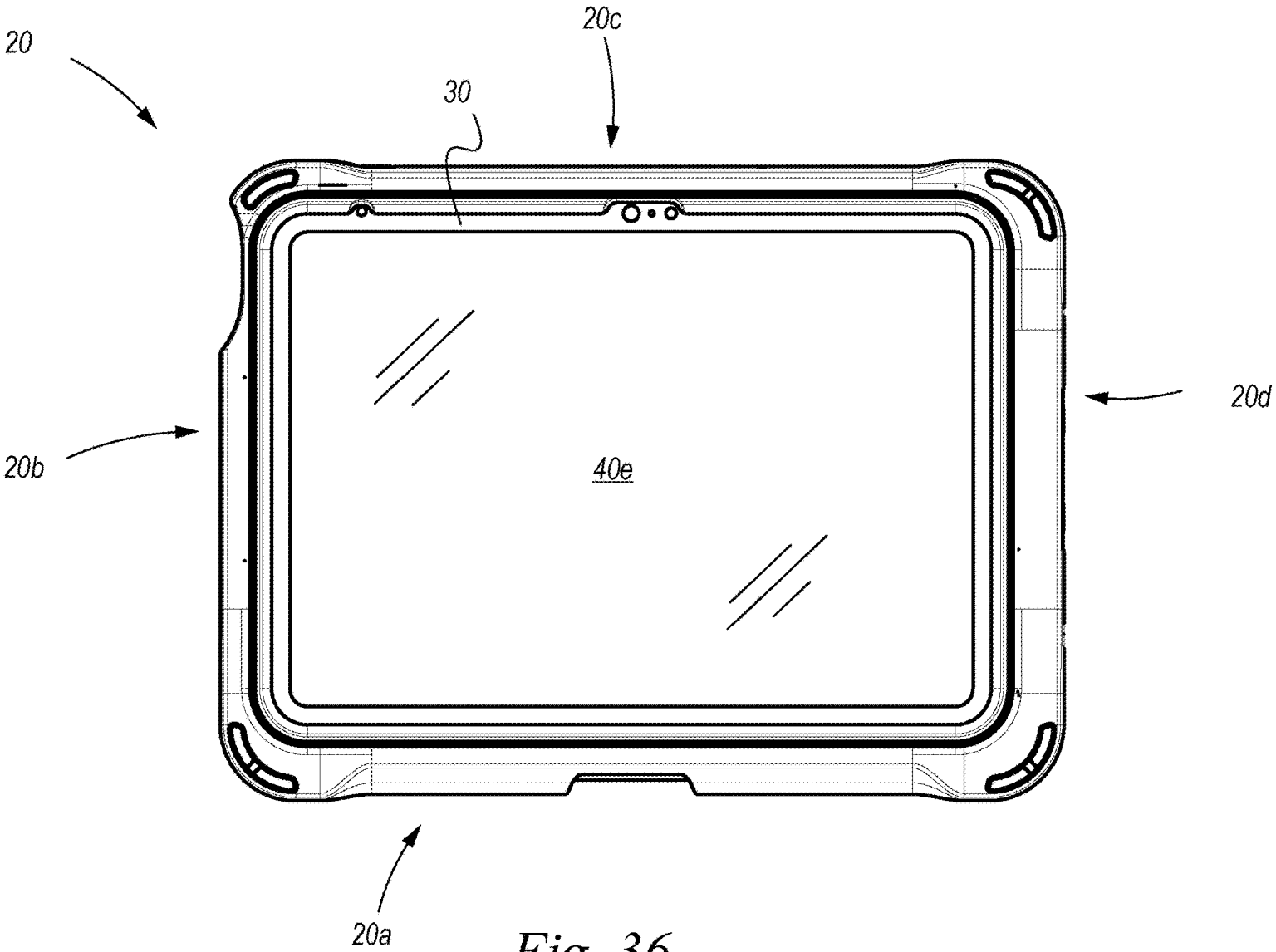

FIG. 36 is a front plan view of the frame member of FIG. 15 coupled with the back member of FIG. 1, the portable electronic device of FIG. 21, and the sheet member of FIG. 27.

Figure 37:
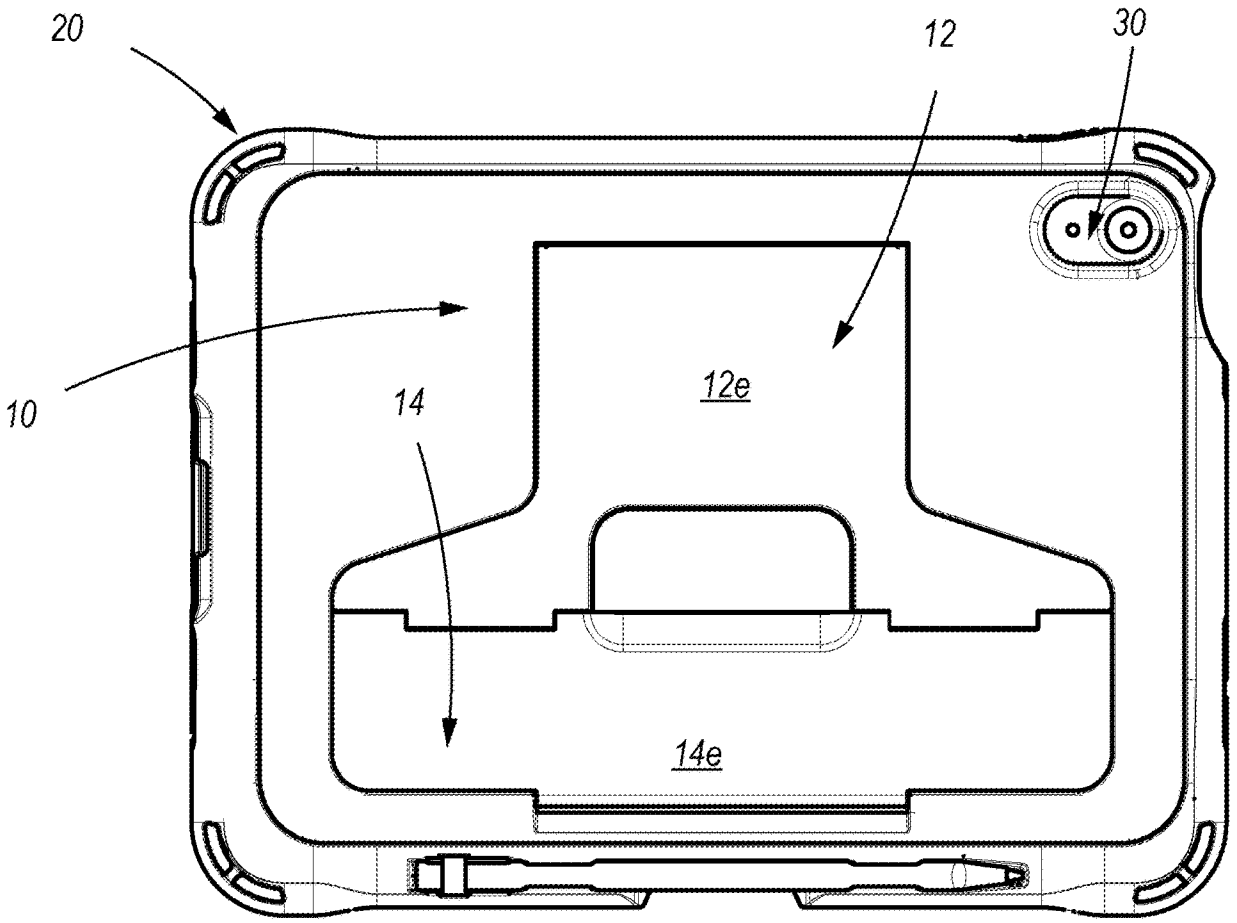

FIG. 37 is a rear plan view of the frame member of FIG. 15 coupled with the back member of FIG. 1, the first stand member of FIG. 4, the second stand member of FIG. 5, the portable electronic device of FIG. 21, and the sheet member of FIG. 27.

Figure 38:
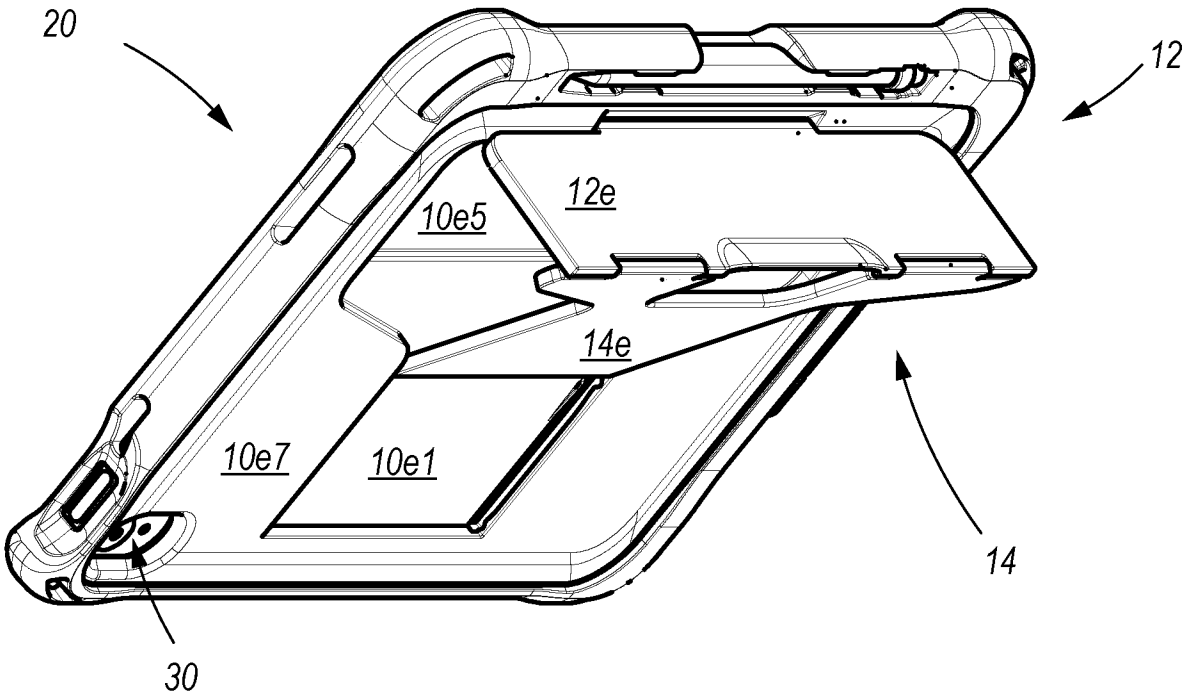

FIG. 38 is a first rear perspective view of the frame member of FIG. 15 coupled with the back member of FIG. 1, the first stand member of FIG. 4, the second stand member of FIG. 5, and the portable electronic device of FIG. 21.

Figure 39:
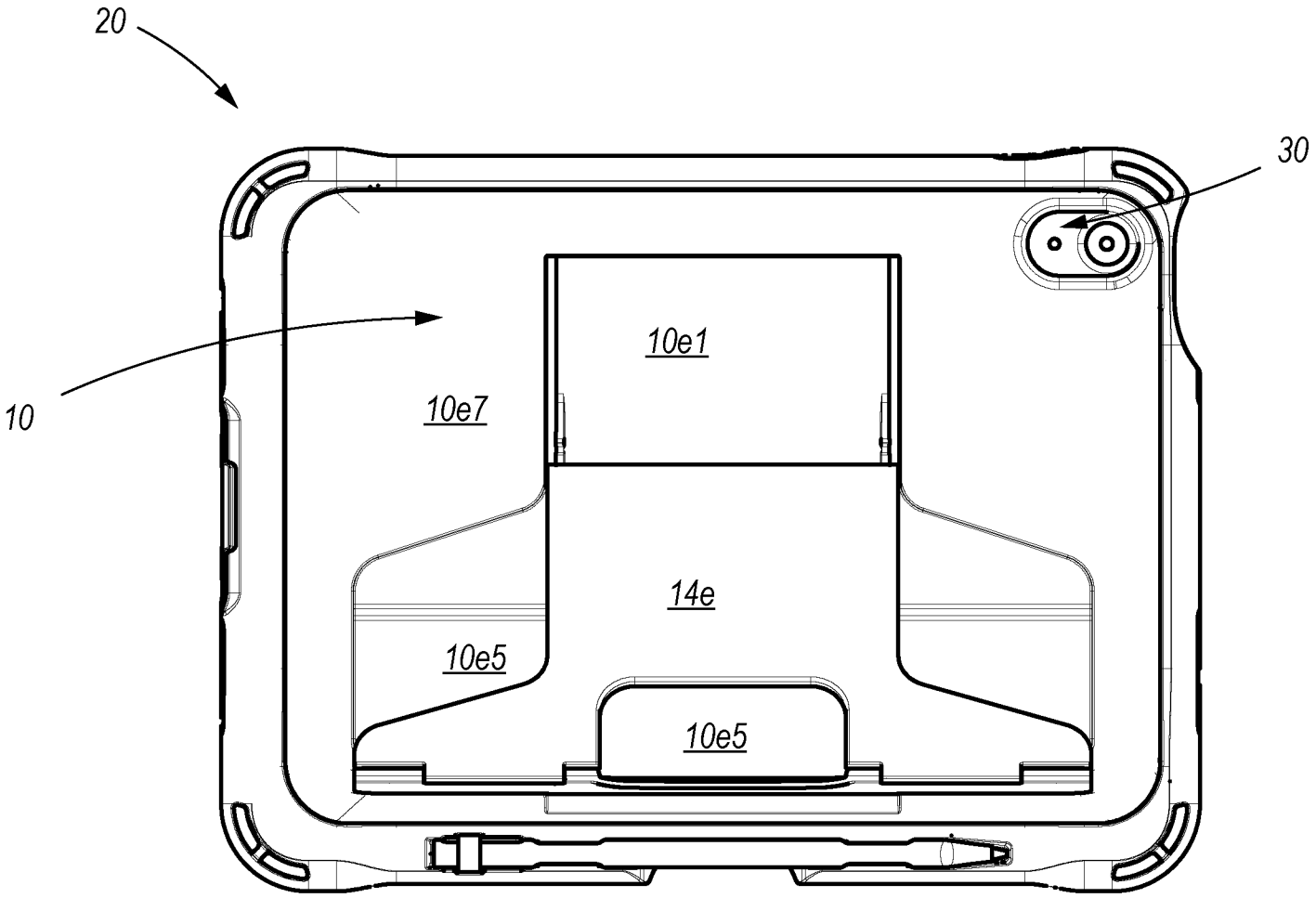

FIG. 39 is a rear plan view of the frame member of FIG. 15 coupled with the back member of FIG. 1, the first stand member of FIG. 4, the second stand member of FIG. 5, and the portable electronic device of FIG. 21.

Figure 40:
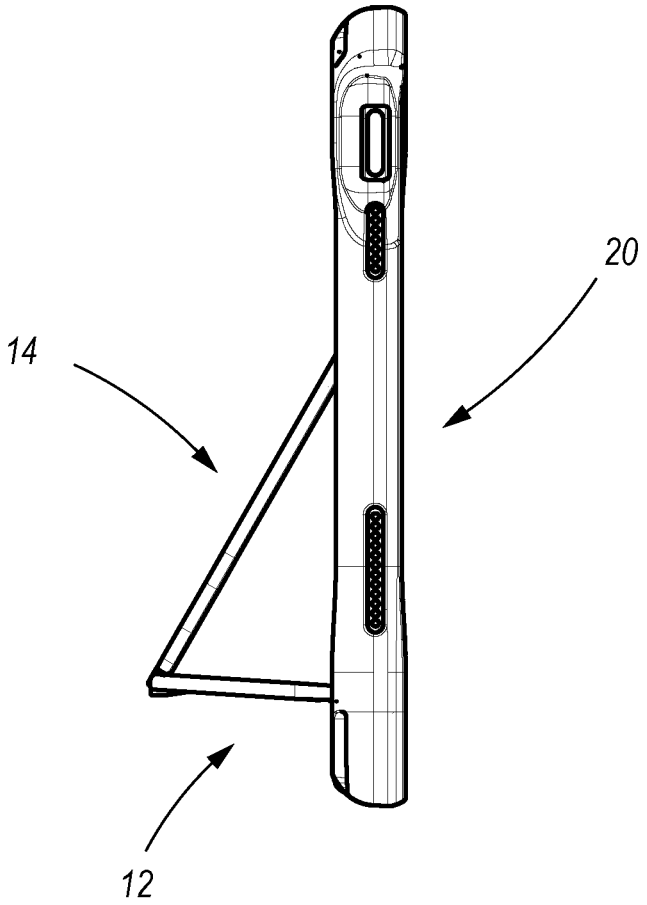

FIG. 40 is a side elevational view of a frame member of FIG. 15 coupled with the first stand member of FIG. 4 and the second stand member of FIG. 5.

Figure 41:
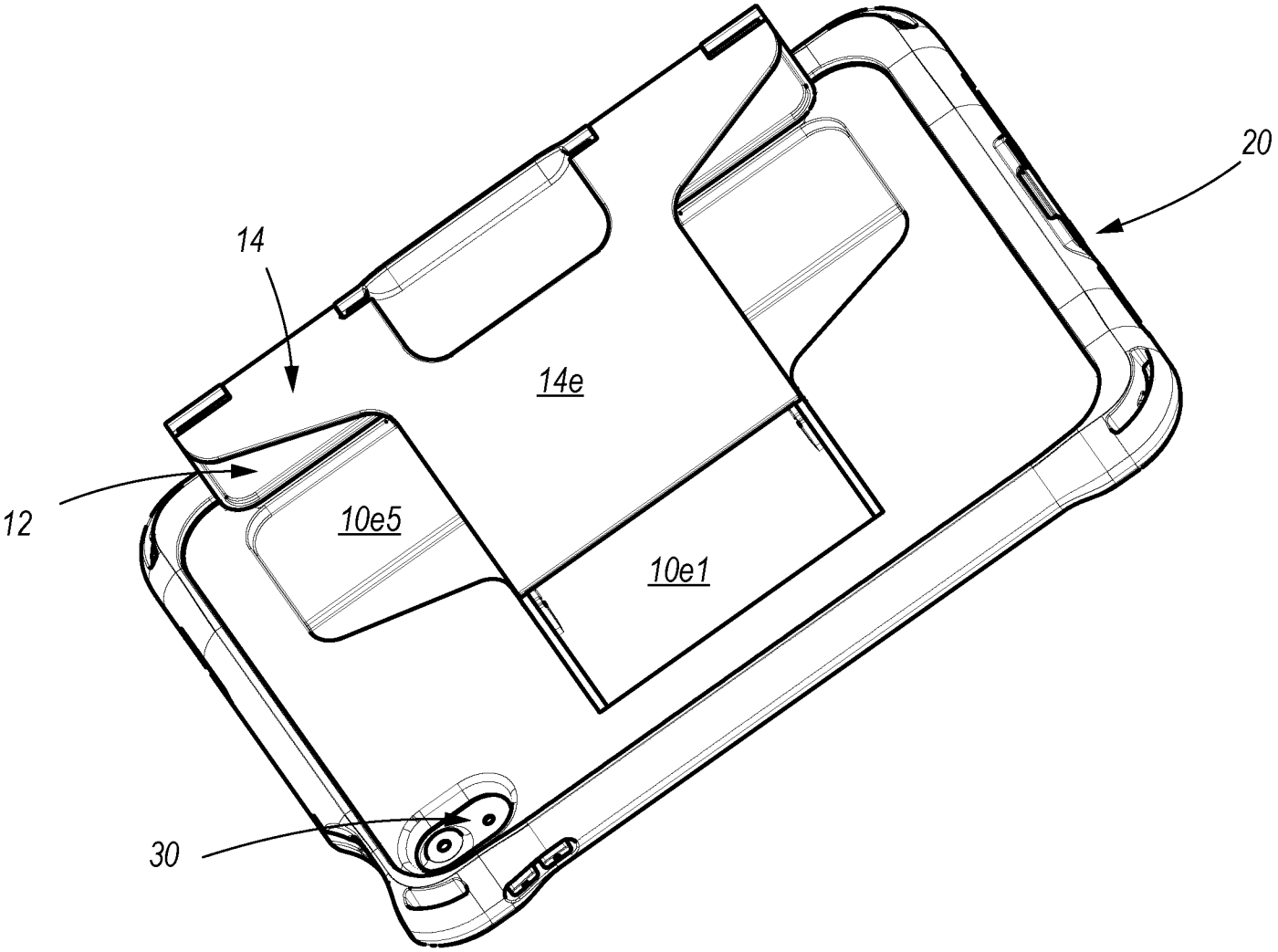

FIG. 41 is a second rear perspective view of the frame member of FIG. 15 coupled with the back member of FIG. 1, the first stand member of FIG. 4, the second stand member of FIG. 5, and the portable electronic device of FIG. 21.

Figure 42:
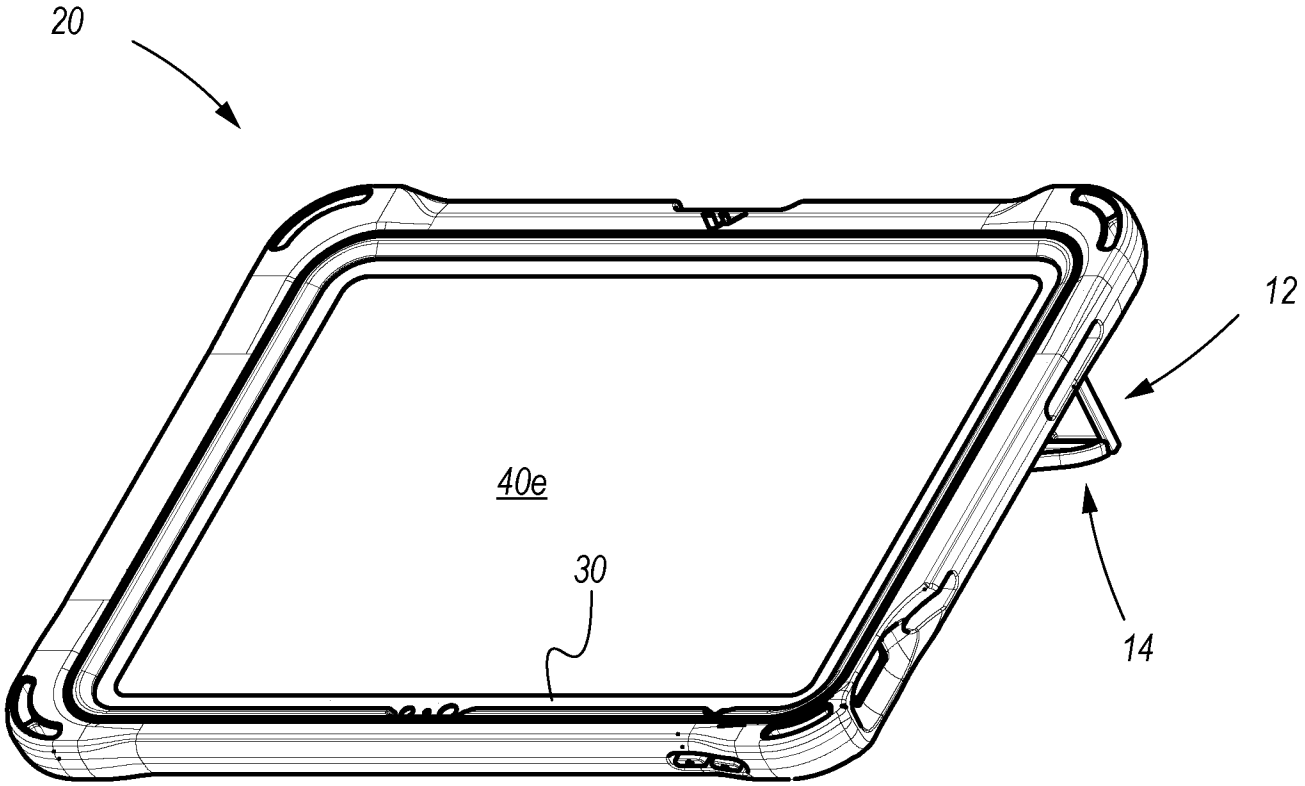

FIG. 42 is a front perspective view of the frame member of FIG. 15 coupled with the first stand member of FIG. 4, the second stand member of FIG. 5, the portable electronic device of FIG. 21, and the sheet member of FIG. 27.

DETAILED DESCRIPTION

In the following detailed description, reference is made to the accompanying drawings, which form a part hereof. In the drawings, similar symbols typically identify similar members, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a rear plan view of a back member of a back assembly. back member 10 includes side portion 10*a*, base portion 10*a*1, side portion 10*b*, base portion 10*b*1, side portion 10*c*, base portion 10*c*1, side portion 10*d*, base portion 10*d*1, exterior portion 10*e*, sunken portion 10*e*1, side portion 10*e*1*a*, side portion 10*e*1*b*, side portion 10*e*1*c*, side portion 10*e*1*d*, side portion 10*e*1*e*, coupling portion 10*e*2, elongated aperture 10*e*2*a*, ramp portion 10*e*2*b*, notch portion 10*e*2*c*, notch portion 10*e*2*d*, coupling portion 10e3, elongated aperture 10e3a, ramp portion 10e3b, notch portion 10e3c, notch portion 10e3d, elongated notch portion 10e4, sunken portion 10e5, side portion 10e5a, side portion 10e5b, side portion 10e5c, side portion 10e5d, side portion 10e5e, side portion 10e5f, side portion 10e5g, elongated notch portion 10e6, floor portion 10e6a, side portion 10e6b, raised portion 10e7, and aperture portion 10e8. FIG. 1 illustrates the back member 10 and its various rear-side structural features. In some implementations, the exterior portion 10e provides a primary rear support surface for the assembly, while the sunken portions (e.g., sunken portions 10e1 and 10e5) define one or more recessed regions configured to receive and accommodate the folding stand members 12 and 14 when not in use. In some implementations, one or more of the coupling portions 10e2 and 10e3 define a stand-coupling structure of the back member 10 for coupling the stand members 12 and 14 to the back member 10. For example, the stand-coupling structure may include elongated apertures (e.g., elongated apertures 10e2a and 10e3a) and associated ramp and notch portions that guide insertion and retention of corresponding coupling features of the stand members. Ramp portions may provide lead-in surfaces facilitating assembly, while notch portions may provide detent or locking engagement to resist unintended release of the stand members during repeated folding and deployment. In some implementations, the elongated notch portions (e.g., elongated notch portions 10e4 and 10e6) and the aperture portion 10e8 provide clearance and/or access features associated with the stand members and/or device features, and may also provide manufacturing advantages such as uniform wall thickness, reduced sink, and controlled flex regions used during assembly and disassembly.

Turning to FIG. 2, depicted therein is a first rear perspective view of the back member of FIG. 1. FIG. 2 illustrates a rear perspective view of the back member 10, including the perimeter side portions and the exterior rear surface. In some implementations, the side portions 10a-10d define perimeter walls that can partially wrap around side portions of the portable electronic device 30 when installed, thereby providing edge protection and assisting in retention.

Turning to FIG. 3, depicted therein is a second rear perspective view of the back member of FIG. 1. FIG. 3 illustrates a rear perspective view of the back member 10, further illustrating that the exterior portion 10e may be generally planar and may include one or more sunken regions. In some implementations, the sunken regions provide clearance for receiving the stand members 12 and 14 in the folded condition, thereby enabling a low-profile stowed configuration.

Turning to FIG. 4, depicted therein is a rear plan view of a first stand member of the back assembly. stand member 12 includes side portion 12a, side portion 12b, peg portion 12b1, edge portion 12b2, edge portion 12b3, side portion 12c, extended portion 12cl, edge portion 12c1a, edge portion 12c1b, edge portion 12c1c, indented portion 12c2, edge portion 12c2a, edge portion 12c2b, edge portion 12c2c, extended portion 12c3, edge portion 12c3a, edge portion 12c3b, edge portion 12c3c, side portion 12d, peg portion 12d1, edge portion 12d2, edge portion 12d3, exterior portion 12e, extended portion 12e1, and extended portion 12e2. FIG. 4 illustrates the first stand member 12 and its peg portions and extended portions. In some implementations, the first stand member 12 serves as a linking member between the second stand member 14 and the back member 10, and may include peg portions that couple with corresponding apertures to define hinge joints and/or back-member coupling joints.

Turning to FIG. 5, depicted therein is a rear plan view of a second stand member of the back assembly. stand member 14 includes side portion 14a, edge portion 14a1, extended portion 14a2, edge portion 14a2a, inner portion 14a2b, edge portion 14a3, side portion 14b, side portion 14c, extended portion 14c1, indented portion 14c2, side aperture 14c2a, peg portion 14c2c, extended portion 14c3, indented portion 14c4, side aperture 14c4a, peg portion 14c4b, edge portion 14c4c, extended portion 14c5, side portion 14d, exterior portion 14e, extended portion 14e1, extended portion 14e2, and extended portion 14e3. FIG. 5 illustrates the second stand member 14 and its extended portions and indented portions. In some implementations, the second stand member 14 serves as a rear-facing support plate in the deployed condition and may include one or more extended portions that define one or more ground-contact regions that bear against a support surface. In some implementations, one or more indented portions provide clearance for adjacent structures and/or define engagement geometry when the stand is folded. In some implementations, one or more peg portions of the second stand member 14 cooperate with corresponding apertures in the first stand member 12 to provide the hinge coupling. The peg portions may be generally cylindrical and may define an axis of rotation, while the corresponding apertures may be shaped to provide retention and smooth pivoting.

Turning to FIG. 6, depicted therein is a rear plan view of the first stand member of FIG. 4 coupled with the second stand member of FIG. 5. FIG. 6 illustrates coupling between the first stand member 12 and the second stand member 14. In some implementations, the coupling between the stand members is a hinge coupling that permits relative pivoting, enabling a folding two-piece construction in which the stand members can be folded flat for storage and opened for use.

Turning to FIG. 7, depicted therein is a rear plan view of the first stand member of FIG. 4 coupled with the second stand member of FIG. 5, and both coupled with the back member of FIG. 1 all of the back assembly. FIG. 7 illustrates the assembled back assembly including the back member 10 and stand members 12, 14. In some implementations, the stand members 12 and 14 are coupled to the back member 10 such that the stand members can fold into a stowed condition substantially flush with the back member and can pivot outward into a deployed condition to support the assembly at an inclined viewing angle. In the stowed condition, the stand members 12 and 14 may be received at least partially within sunken portions of the back member 10 so that exterior surfaces of the stand members are recessed relative to exterior perimeter regions of the back member 10. In the deployed condition, the hinge coupling between stand members 12 and 14 permits the two pieces to assume an angled relationship, thereby forming a braced support that resists collapse.

Turning to FIG. 8, depicted therein is a front plan view of the back member of FIG. 1. interior portion 10f includes sunken portion 10f1, sunken portion 10f2, raised portion 10f3 with elongated notch 10f3a, elongated notch 10f3b, coupling portion 10f4 with notch portion 10f4a, notch portion 10f4b, notch portion 10f4c, coupling portion 10f5 with notch portion 10f5a, notch portion 10f5b, and notch portion 10f5c. FIG. 8 illustrates the interior portion 10f of the back member 10, including sunken portions and raised portions. In some implementations, the sunken portions 10f1, 10f2 provide relief for device features and/or stand nesting, while the raised portion 10*f*3 provides internal reinforcement and may define one or more elongated notches 10*f*3*a*, 10*f*3*b* that cooperate with corresponding features of the frame member 20 or stand members to provide alignment and retention.

Turning to FIG. 9, depicted therein is a front perspective view of the back member of FIG. 1. FIG. 9 illustrates a front perspective view of the back member 10. In some implementations, the back member 10 includes internal stiffening geometry that increases rigidity without materially increasing thickness, and may further define support surfaces for contacting the rear surface portion 30*f* of the portable electronic device 30 when installed.

Turning to FIG. 10, depicted therein is a front plan view of the first stand member of FIG. 4. interior portion 12*f* includes raised portion 12*f*1 with side aperture 12*f*1*a*, side aperture 12*f*1*b*, sunken portion 12*f*2, sunken portion 12*f*3, raised portion 12*f*4 with side aperture 12*f*4*a*, side aperture 12*f*4*b*, raised portion 12*f*5 with side aperture 12*f*5*a*, raised portion 12*f*6 with side aperture 12*f*6*a*. FIG. 10 illustrates interior structural portions of the first stand member 12. In some implementations, the raised portions (e.g., raised portions 12*f*1, 12*f*4-12*f*6) provide reinforcement adjacent the peg portions and adjacent coupling apertures, thereby improving durability of the hinge coupling and improving resistance to cracking during repeated folding cycles.

Turning to FIG. 11, depicted therein is a front plan view of the second stand member of FIG. 5 includes edge portion 14*a*2*a*, inner portion 14*a*2*b*, side aperture 14*c*4*a*, peg portion 14*c*4*b*, interior portion 14*f* with raised portion 14*f*1, raised portion 14*f*2, raised portion 14*f*3, and sunken portion 14*f*4. FIG. 11 illustrates interior structural portions of the second stand member 14. In some implementations, one or more raised portions (e.g., raised portions 14*f*1-14*f*3) and a sunken portion (e.g., sunken portion 14*f*4) cooperate to provide stiffness while maintaining a thin profile, and can further provide localized bearing regions that contact the first stand member 12 and/or the back member 10 during folding and deployment.

Turning to FIG. 12, depicted therein is a front plan view of the first stand member of FIG. 4 coupled with the second stand member of FIG. 5. FIG. 12 illustrates the first and second stand members 12 and 14 coupled together, showing that the coupling can define a hinge axis about which one stand member pivots relative to the other. This hinge coupling enables a folding construction in which the stand members can fold toward one another into a compact, flat condition when not in use, and can be angled relative to one another when the stand is being used to support the assembly. In some implementations, the hinge coupling is formed by peg-and-aperture engagement such that a peg portion on one of the stand members is received within a side aperture of the other stand member to provide a pivot joint. The peg-and-aperture engagement may be arranged to permit assembly by elastic deformation during installation while maintaining retention during normal use.

Turning to FIG. 13, depicted therein is a front plan view of the first stand member of FIG. 4 coupled with the second stand member of FIG. 5, and both coupled with the back member of FIG. 1 all of the back assembly includes rib portion 10*a*2, rib portion 10*b*2, and rib portion 10*c*2. FIG. 13 illustrates the assembled condition in which the stand members 12 and 14 are coupled to the back member 10. In this assembled condition, one or more rib portions (e.g., rib portions 10*a*2, 10*b*2, 10*c*2) can provide stiffness along corresponding edges of the back member 10 and can also serve as perimeter reinforcement that resists bending under load when the stand is deployed.

Turning to FIG. 14, depicted therein is a right-side elevational view of the back member of FIG. 1 includes side portion 10*d*2. FIG. 14 illustrates a side elevational view of the back member 10, including side portion 10*d*2. In some implementations, the side portions of the back member 10 can include localized thickened regions, relief regions, or curvature selected to improve ergonomics and impact distribution while maintaining compatibility with the frame member 20.

Turning to FIG. 15, depicted therein is a rear plan view of a frame member. frame member 20 includes side portion 20*a*, ledge interior surface portion 20*a*3, rear perimeter body portion 20*a*4, side portion 20*b* with ledge interior surface portion 20*b*3, rear perimeter body portion 20*b*4, side portion 20*c* with ledge interior surface portion 20*c*3, rear perimeter body portion 20*c*4, side portion 20*d* with ledge interior surface portion 20*d*3, rear perimeter body portion 20*d*4, and central opening 20*e*.

Turning to FIG. 16, depicted therein is a rear perspective view of the frame member of FIG. 15 include groove portion 20*b*5 and groove portion 20*c*5. FIGS. 15-16 illustrate that the frame member 20 defines a central opening 20*e* and perimeter body portions that surround the opening. In some implementations, the perimeter body portions define a continuous protective rim and may include one or more groove portions (e.g., groove portions 20*b*5, 20*c*5, 20*d*5) that act as coupling features for engagement with corresponding structures of the back member 10. In some implementations, one or more of the groove portions extend along multiple sides of the frame member 20 and collectively define a circumferential groove portion extending around at least a portion of the perimeter of the central opening 20*e*. In some implementations, the ledge interior surface portions 20*a*3-20*d*3 define an inwardly facing ledge that can overlie, abut, or otherwise engage the sheet member 40 and/or the front perimeter regions of the portable electronic device 30. The rear perimeter body portions 20*a*4-20*d*4 may provide structural thickness and stiffness for the frame member 20, thereby improving impact resistance.

Turning to FIG. 17, depicted therein is a front plan view of the frame member of FIG. 15 include ledge exterior surface portion 20*a*1, front perimeter body portion 20*a*2, ledge exterior surface portion 20*b*1, front perimeter body portion 20*b*2, ledge exterior surface portion 20*c*1, front perimeter body portion 20*c*2, ledge exterior surface portion 20*d*1, and front perimeter body portion 20*d*2. FIG. 17 further illustrates the front-facing geometry of the frame member 20. In some implementations, the ledge exterior surface portions 20*a*1-20*d*1 and front perimeter body portions 20*a*2-20*d*2 define a bezel boundary that surrounds the display portion 30*e* in the assembled configuration, while limiting obstruction of the active display area.

Turning to FIG. 18, depicted therein is a rear perspective view of the frame member of FIG. 15 includes groove portion 20*d*5. FIG. 18 further illustrates groove portion 20*d*5 of the frame member 20. In some implementations, a groove portion (e.g., groove portion 20*d*5) cooperates with a corresponding rib portion of the back member 10 to resist separation and provide alignment between the frame member 20 and the back member 10 during assembly, including by receiving the rib portion within the groove portion along at least one side of the frame member 20.

Turning to FIG. 19, depicted therein is a front plan view of the frame member of FIG. 15 coupled with the back member of FIG. 1. FIG. 19 illustrates the frame member 20 coupled with the back member 10. In some implementations, coupling can be achieved by relative movement bringing the members into engagement and then sliding, snapping, or otherwise interlocking cooperating coupling structures so that the frame member 20 overlies or surrounds perimeter regions of the back member 10.

Turning to FIG. 20, depicted therein is a rear plan view of the first stand member of FIG. 4 coupled with the second stand member of FIG. 5, and both coupled with the back member of FIG. 1 of the back assembly, coupled with the frame member of FIG. 15. FIG. 20 illustrates the back assembly coupled with the frame member 20. In some implementations, the coupling between the back member 10 and the frame member 20 provides a clamshell-type retention arrangement that captures the portable electronic device 30 between the members 10 and 20 when assembled, thereby resisting separation and limiting relative movement.

Turning to FIG. 21, depicted therein is a front elevational view of a portable electronic device includes portable electronic device 30 with side portion 30*a*, side portion 30*b*, side portion 30*c*, side portion 30*d*, and display portion 30*e*. FIG. 21 illustrates the portable electronic device 30 and its side portions 30*a*-30*d* and display portion 30*e*. The side portions 30*a*-30*d* may include local curvature, bevels, or edge radii that can be matched by corresponding portions of the back member 10 and/or the frame member 20 for improved fit and retention.

Turning to FIG. 22, depicted therein is a rear elevational view of the portable electronic device of FIG. 21 include rear surface portion 30*f*. FIG. 22 illustrates the rear surface portion 30*f* of the portable electronic device 30. In some implementations, the rear surface portion 30*f* is a substantially planar surface that may be supported by the exterior portion 10*e* of the back member 10 when the device is installed.

Turning to FIG. 23, depicted therein is a front-right-top isometric view of the portable electronic device of FIG. 21. FIG. 23 illustrates the portable electronic device 30 in an isometric view. This figure may be understood as depicting the device in a standalone condition prior to installation into the back member 10 and prior to coupling of the frame member 20.

Turning to FIG. 24, depicted therein is a front-left-top isometric view of the portable electronic device of FIG. 21. FIG. 24 illustrates the portable electronic device 30 in an isometric view from a different perspective, further illustrating that the device can be generally rectangular with rounded corners. The depicted shape and relative proportions are illustrative, and the structures described herein can be scaled or adapted for different form factors.

Turning to FIG. 25, depicted therein is a back-left-top isometric view of the portable electronic device of FIG. 21. FIG. 25 illustrates the portable electronic device 30 in an isometric view from a different perspective. The depicted perspectives collectively illustrate representative locations for features such as buttons, ports, speakers, microphones, and cameras, and it will be understood that the protective components described herein may be adapted to accommodate such features in different device models.

Turning to FIG. 26, depicted therein is a front-right-bottom isometric view of the portable electronic device of FIG. 21. FIG. 26 illustrates the portable electronic device 30 in an isometric view, showing the relationship between the side portions 30*a*-30*d* and the display portion 30*e*. In some implementations, the device geometry depicted is representative and may correspond to a tablet, phone, handheld computer, or other portable electronic device.

Turning to FIG. 27, depicted therein is a front elevational view of a sheet member includes transparent sheet 40 with side portion 40*a*, side portion 40*b*, side portion 40*c*, side portion 40*d*, and interior surface 40*e*. FIG. 27 illustrates the transparent sheet 40 and its perimeter side portions 40*a*-40*d* surrounding the interior surface 40*e*. In some implementations, the sheet member 40 is sized so that the interior surface 40*e* overlies substantially all of the active display portion 30*e*, while the perimeter side portions 40*a*-40*d* provide edge margin regions that can be retained by the frame member 20.

Turning to FIG. 28, depicted therein is a rear elevational view of the sheet member of FIG. 27 includes exterior surface 40*f*. FIG. 28 illustrates an exterior surface 40*f* of the sheet member 40. In some implementations, the exterior surface 40*f* faces outwardly in the assembled configuration and may include a surface finish selected to reduce fingerprint visibility and to improve scratch resistance.

Turning to FIG. 29, depicted therein is a back-right-top isometric view of the sheet member of FIG. 27. FIG. 29 further illustrates the sheet member 40 in an isometric view, showing that the sheet member may be generally planar while optionally including rounded edges or chamfers along its perimeter. Such perimeter shaping can reduce sharp edges and can improve compatibility with the frame member 20 and the display perimeter of the portable electronic device 30.

Turning to FIG. 30, depicted therein is a back-left-top isometric view of the sheet member of FIG. 27. FIG. 30 further illustrates the sheet member 40 in an isometric view. In some implementations, the sheet member 40 is a transparent member formed from glass, tempered glass, polymer, or a laminate, and may include optional coatings (e.g., oleophobic or anti-glare coatings) to improve user experience.

Turning to FIG. 31, depicted therein is a right side elevational view of the back member of FIG. 1 coupled with the portable electronic device of FIG. 27. FIG. 31 illustrates a side elevational view of the back member 10 coupled with the portable electronic device 30, showing that the back member 10 may extend around at least a portion of the device perimeter while maintaining a generally low-profile sidewall thickness. In some implementations, the sidewall geometry of the back member 10 is selected to provide impact protection while limiting overall added bulk.

Turning to FIG. 32, depicted therein is a top plan view of the back member of FIG. 1 coupled with the portable electronic device of FIG. 27. FIG. 32 illustrates a top plan view of the back member 10 coupled with the portable electronic device 30. This view can illustrate that the back member 10 may define one or more openings, recesses, or relief features aligned with device controls or ports located along the top edge of the portable electronic device.

Turning to FIG. 33, depicted therein is a front elevational view of the back member of FIG. 1 coupled with the portable electronic device of FIG. 27. FIG. 33 illustrates a front elevational view of the back member 10 coupled with the portable electronic device 30. In this view, the back member 10 may be understood as providing a rear support structure that does not obstruct the user-facing display portion 30*e*, while optionally providing localized protective coverage around corners and edges that are more susceptible to impact.

Turning to FIG. 34, depicted therein is a back-right-top isometric view of the back member of FIG. 1 coupled with the portable electronic device of FIG. 27. FIG. 34 illustrates a back-right-top isometric view of the back member 10 coupled to the portable electronic device 30. In some implementations, the back member 10 may be dimensioned to closely conform to the rear surface portion 30*f* and to portions of the side portions 30*a*-30*d* to reduce relative motion between the device and the back member during drops or impacts.

Turning to FIG. 35, depicted therein is a front-left-top isometric view of the back member of FIG. 1 coupled with the portable electronic device of FIG. 27. FIG. 35 further illustrates the back member 10 coupled to the portable electronic device 30 from a front-left-top isometric perspective. In this configuration, the back member 10 can be seen to extend along one or more side portions of the portable electronic device 30, providing protective coverage and assisting in retention of the device within the back assembly.

Turning to FIG. 36, depicted therein is a front plan view of the frame member of FIG. 15 coupled with the back member of FIG. 1, the portable electronic device of FIG. 21, and the sheet member of FIG. 27. FIG. 36 illustrates the front plan view of the assembled configuration including the frame member 20, the back member 10, the portable electronic device 30, and the sheet member 40. In this assembled condition, the sheet member 40 may be positioned between the frame member 20 and the portable electronic device 30 such that the sheet member overlies the display portion 30*e* while remaining visible and touch-responsive through the sheet member. In some implementations, the frame member 20 provides a perimeter retention feature that overlies an outer margin of the sheet member 40, thereby constraining lateral movement of the sheet member during use. The frame member 20 may also serve as a protective front bezel that reduces the likelihood of edge chipping or corner peeling of the sheet member 40.

Turning to FIG. 37, depicted therein is a rear plan view of the frame member of FIG. 15 coupled with the back member of FIG. 1, the first stand member of FIG. 4, the second stand member of FIG. 5, the portable electronic device of FIG. 21, and the sheet member of FIG. 27. FIG. 37 illustrates a rear plan view of the fully assembled configuration including the frame member 20, the back member 10, the stand members 12 and 14, the portable electronic device 30, and the sheet member 40. This view illustrates that the back member 10 and frame member 20 may enclose and protect the rear surface portion 30*f* and side portions 30*a*-30*d* of the device while leaving appropriate access openings for device features such as speakers, ports, buttons, and cameras. In some implementations, one or more of the side portions 20*a*-20*d* of the frame member 20 may include local recesses or openings aligned with corresponding device features, and the back member 10 may similarly include local openings aligned with rear-facing device features. The assembled configuration may thereby provide protective coverage without obstructing normal operation of the portable electronic device 30.

Turning to FIG. 38, depicted therein is a first rear perspective view of the frame member of FIG. 15 coupled with the back member of FIG. 1, the first stand member of FIG. 4, the second stand member of FIG. 5, and the portable electronic device of FIG. 21. [00116*a*] FIG. 38 provides a rear perspective view of an assembled configuration in which the frame member 20 and back member 10 cooperate to retain the portable electronic device 30. This view further illustrates that the stand members 12, 14 can be integrated into the back assembly while maintaining a generally continuous protective perimeter around the device. In some implementations, the frame member 20 and the back member 10 define cooperating coupling features that resist separation along a direction normal to the rear surface portion 30*f*, while permitting assembly by relative movement along a direction parallel to the rear surface portion 30*f*. Such coupling can be provided, for example, by grooves, ledges, tabs, or other interlocking geometry formed on one or both of the members 10 and 20.

Turning to FIG. 39, depicted therein is a rear plan view of the frame member of FIG. 15 coupled with the back member of FIG. 1, the first stand member of FIG. 4, the second stand member of FIG. 5, and the portable electronic device of FIG. 21. FIG. 39 provides a rear plan view of the assembled frame member 20 and back assembly, further illustrating the relationship between the back member 10, the stand members 12 and 14, and the portable electronic device 30. In this configuration, the stand members may be disposed within the perimeter of the frame member 20 in a stowed condition, thereby reducing protrusion and improving pocketability or stackability of the assembly. In some implementations, the back member 10 defines one or more recessed regions, including one or more of the sunken portions 10*e*1 and 10*e*5, that receive the stand members 12 and 14 when the stand members are folded flat. In some implementations, when the stand members 12 and 14 are disposed in the recessed region in the stowed condition, exterior surfaces of the stand members are recessed relative to adjacent exterior regions of the back member 10 and/or are substantially flush with adjacent exterior regions of the back member 10. This can reduce snag points and can help protect the stand members from unintended opening during transport.

Turning to FIG. 40, depicted therein is a side elevational view of a frame member of FIG. 15 coupled with the first stand member of FIG. 4 and the second stand member of FIG. 5. FIG. 40 illustrates a side elevational view of the frame member 20 coupled with the stand members 12, 14, showing that the stand members can support the frame member in an inclined orientation relative to an underlying surface. In this condition, the stand members 12, 14 may cooperate to define a stable support angle that resists collapse under typical touch input forces applied to the display portion 30*e*. In some implementations, the stand members 12, 14 define a folding linkage in which the hinge axis between the stand members permits the stand to fold flat when not in use, and to open to a predetermined or selectable included angle when the stand is being used. The included angle may be limited by engagement between portions of the stand members and/or engagement between a stand member and a feature of the back member 10.

Turning to FIG. 41, depicted therein is a second rear perspective view of the frame member of FIG. 15 coupled with the back member of FIG. 1, the first stand member of FIG. 4, the second stand member of FIG. 5, and the portable electronic device of FIG. 21. FIG. 41 provides a further perspective view of the rear of the assembled structure, illustrating the back member 10 positioned rearward of the portable electronic device 30 and the stand members 12, 14 coupled to the back member 10. This view also illustrates that the stand members 12, 14 are capable of being deployed into an angled support position while remaining coupled to the back member 10, thereby allowing a user to selectively support the assembly on an underlying surface. In the deployed condition, the two-piece stand construction may define a braced geometry in which one of the stand members bears against the underlying surface while the other stand member bears against the back member 10, thereby distributing support loads through multiple contact regions rather than through a single thin wall or hinge leaf.

Turning to FIG. 42, depicted therein is a front perspective view of the frame member of FIG. 15 coupled with the first stand member of FIG. 4, the second stand member of FIG.

5, the portable electronic device of FIG. 21, and the sheet member of FIG. 27. The assembly of FIG. 42 further illustrates that the frame member 20, when installed, defines a forwardly facing perimeter boundary around the display region of the portable electronic device 30, while the sheet member 40 spans across the display portion 30*e*. In this condition, the frame member 20 may cooperate with the back member 10 to retain the sheet member 40 in a stable position adjacent the display portion 30*e*, including by applying a compressive or clamping retention along one or more of the side portions 40*a*-40*d* to resist shifting of the sheet member 40 during handling or impact events. In some implementations, the frame member 20 provides a continuous or substantially continuous protective rim at the front of the assembly, while the back member 10 provides a rear support structure, and the sheet member 40 provides a transparent protective barrier for the display portion 30*e*. These structures may be selected and dimensioned so that the portable electronic device 30 is retained in a stable installed position while permitting the sheet member 40 to be removable and replaceable as a consumable component.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A case system for a portable electronic device, comprising:

(I) a back member including:

(A) a rear surface portion, (B) an interior surface portion opposite the rear surface portion, (C) a first recessed region, and (D) a first stand-coupling structure including at least one elongated aperture, at least one ramp portion disposed adjacent the at least one elongated aperture, and at least one notch portion disposed along the at least one elongated aperture;

(II) a frame member including:

(A) a perimeter body portion defining a central opening, and (B) an inwardly extending ledge portion; and (III) a two-piece folding stand including:

(A) a first stand member, and (B) a second stand member hingedly coupled to the first stand member, wherein the first stand member is coupled to the back member by the first stand-coupling structure, the first stand member including at least one peg portion slidably received within the at least one elongated aperture, wherein the first stand member and the second stand member are movable between (i) a stowed condition in which the first stand member and the second stand member are folded to lie along the back member and (ii) a deployed condition in which the first stand member and the second stand member are angled with respect to one another to support the case system on a support surface, and wherein, in the stowed condition, at least a portion of the two-piece folding stand is received within the first recessed region, the at least one peg portion being positioned within the at least one notch portion to resist movement of the first stand member relative to the back member.

2. The case system of claim 1, wherein the first stand-coupling structure includes at least one elongated aperture and at least one notch portion, the at least one notch portion including a first notch portion and a second notch portion spaced from one another along the at least one elongated aperture.

3. The case system of claim 2, wherein the first stand member includes [a peg portion received in the at least one elongated aperture, the peg portion being selectively seatable in the first notch portion and the second notch portion].

4. The case system of claim 1, wherein the hinge coupling includes a peg portion on one of the first stand member and the second stand member, and a side aperture on the other of the first stand member and the second stand member, the peg portion being received in the side aperture.

5. The case system of claim 4, wherein the second stand member includes a plurality of extended portions defining at least one ground-contact region in the deployed condition.

6. The case system of claim 1, wherein the back member includes at least one rib portion, and wherein the frame member includes a circumferential groove portion receiving the at least one rib portion.

7. The case system of claim 1, further comprising a transparent sheet disposed along the inwardly extending ledge portion and spanning across the central opening.

8. A back assembly for a portable electronic device, comprising:

(I) a back member couplable with the portable electronic device and including:

(A) a rear surface portion, (B) an interior surface portion opposite the rear surface portion, (C) a recessed region, and (D) a stand-coupling structure including at least one elongated aperture, at least one ramp portion disposed adjacent the at least one elongated aperture, and at least one notch portion disposed along the at least one elongated aperture; and (II) a two-piece folding stand coupled with the back member by the stand-coupling structure, the two-piece folding stand including:

(A) a first stand member coupled with the stand-coupling structure, and (B) a second stand member hingedly coupled to the first stand member, wherein the first stand member includes at least one peg portion slidably received within the at least one elongated aperture, wherein the two-piece folding stand is movable between (i) a stowed condition in which at least a portion of the two-piece folding stand is received in the recessed region and (ii) a deployed condition in which the first stand member and the second stand member are angled with respect to one another to support the back assembly on a support surface while the back member remains coupled with the portable electronic device, the at least one peg portion being positioned within the at least one notch portion in the stowed condition to resist movement of the first stand member relative to the back member.

9. The back assembly of claim 8, further comprising a frame member couplable with the portable electronic device and couplable with the back member.

10. The back assembly of claim 9, wherein the frame member includes a perimeter body defining a central opening.

11. The back assembly of claim 10, wherein the frame member includes an inwardly extending ledge portion adjacent the central opening.

12. The back assembly of claim 8, wherein the hinge coupling includes a peg portion on the first stand member and a side aperture on the second stand member, the peg portion being received in the side aperture.

13. The back assembly of claim 12, wherein the second stand member includes a second side aperture receiving a second peg portion of the first stand member.

14. The back assembly of claim 8, wherein the recessed region includes a sunken portion of the back member.

15. A modular enclosure system for a portable electronic device, comprising:

(I) a back assembly including:

(A) a back member including a recessed region and a stand-coupling structure including at least one elongated aperture, at least one ramp portion disposed adjacent the at least one elongated aperture, and at least one notch portion disposed along the at least one elongated aperture, and (B) a two-piece folding stand including a first stand member and a second stand member hingedly coupled to the first stand member, the first stand member being coupled to the stand-coupling structure, the first stand member including at least one peg portion slidably received within the at least one elongated aperture; and (II) a frame member removably couplable with the back assembly and including:

(A) a perimeter body defining a central opening, and (B) a ledge portion adjacent the central opening;

wherein, when the frame member is coupled with the back assembly, the portable electronic device is retainable between the frame member and the back member, and wherein the two-piece folding stand is movable between a stowed condition in which the two-piece folding stand is received in the recessed region and a deployed condition in which the first stand member and the second stand member are angled with respect to one another to support the modular enclosure system on a support surface, the at least one peg portion being positioned within the at least one notch portion in the stowed condition to resist movement of the first stand member relative to the back member.

16. The modular enclosure system of claim 15, wherein the back member includes a rib portion and the frame member includes a groove portion receiving the rib portion.

17. The modular enclosure system of claim 16, wherein the groove portion extends along at least two sides of the perimeter body.

18. The modular enclosure system of claim 15, wherein the stand-coupling structure includes an elongated aperture, a ramp portion adjacent the elongated aperture, and a first notch portion and a second notch portion spaced from one another along the elongated aperture.

19. The modular enclosure system of claim 18, wherein the stand-coupling structure further includes the first stand member includes a coupling feature comprising a peg portion seated in one of the first notch portion and the second notch portion in the stowed condition.

20. The modular enclosure system of claim 15, further comprising a transparent sheet supported by the ledge portion and spanning across the central opening.

* * * * *